US012276033B2

(12) United States Patent
Abel

(10) Patent No.: US 12,276,033 B2
(45) **Date of Patent: *Apr. 15, 2025**

(54) METHODS FOR WET ETCHING OF NOBLE METALS

(71) Applicant: Tokyo Electron Limited, Tokyo (JP)

(72) Inventor: Paul Abel, Austin, TX (US)

(73) Assignee: Tokyo Electron Limited, Tokyo (JP)

( * ) Notice: Subject to any disclaimer, the term of this patent is extended or adjusted under 35 U.S.C. 154(b) by 367 days.

This patent is subject to a terminal disclaimer.

(21) Appl. No.: 17/986,160

(22) Filed: Nov. 14, 2022

(65) Prior Publication Data

US 2023/0121246 A1 Apr. 20, 2023

Related U.S. Application Data

(63) Continuation-in-part of application No. 17/674,579, filed on Feb. 17, 2022, now Pat. No. 11,802,342.

(60) Provisional application No. 63/257,226, filed on Oct. 19, 2021.

(51) Int. Cl.
*C23F 1/30* (2006.01)

(52) U.S. Cl.
CPC ..... *C23F 1/30* (2013.01)

(58) Field of Classification Search
CPC ... C23F 1/30; C23F 1/40; C23C 22/58; C23G 1/10
See application file for complete search history.

(56) References Cited

U.S. PATENT DOCUMENTS

| | | | |
|---|---|---|---|
| 5,374,328 | A | 12/1994 | Remba et al. |
| 6,616,014 | B1 | 9/2003 | Pozniak et al. |
| 6,841,031 | B2 | 1/2005 | Iwata et al. |
| 6,896,600 | B1 | 5/2005 | Wu et al. |
| 8,039,382 | B2 | 10/2011 | Fang et al. |
| 8,647,523 | B2 | 2/2014 | Takahashi et al. |
| 10,157,756 | B2 | 12/2018 | Yamada |
| 10,982,335 | B2 | 4/2021 | Abel |

(Continued)

FOREIGN PATENT DOCUMENTS

| | | |
|---|---|---|
| KR | 20130028014 | 3/2013 |
| KR | 1020170022922 | 3/2017 |

(Continued)

OTHER PUBLICATIONS

International Search Report issued in Application No. PCT/US2019/061683, Mar. 13, 2020, 9 pgs.

(Continued)

*Primary Examiner* — Binh X Tran
(74) *Attorney, Agent, or Firm* — Egan, Enders & Huston LLP.

(57) ABSTRACT

The present disclosure provides improved wet etch processes and methods for etching noble metals. More specifically, the present disclosure provides various embodiments of wet etch processes and methods that utilize new etch chemistries for etching noble metals, such as ruthenium (Ru), gold (Au), platinum (Pt) and iridium (Ir), in a wet etch process. In general, the disclosed embodiments expose a noble metal surface to a first etch solution to chemically modify the noble metal surface and form a noble metal salt passivation layer, which can then be selectively dissolved in a second etch solution to etch the noble metal surface.

24 Claims, 14 Drawing Sheets

(56) References Cited

U.S. PATENT DOCUMENTS

| | | | | |
|---|---|---|---|---|
| 11,802,342 | B2 * | 10/2023 | Abel | C23G 1/20 |
| 2002/0004303 | A1 | 1/2002 | Agnello | |
| 2003/0087528 | A1 | 5/2003 | Kruwinus | |
| 2006/0289389 | A1 | 12/2006 | Shea | |
| 2009/0007938 | A1 | 1/2009 | Dubreuil et al. | |
| 2009/0047790 | A1 | 2/2009 | Raghu et al. | |
| 2010/0279435 | A1 | 11/2010 | Xu et al. | |
| 2011/0094888 | A1 | 4/2011 | Chen et al. | |
| 2012/0031768 | A1 | 2/2012 | Reid et al. | |
| 2014/0091052 | A1 | 4/2014 | Nagashima et al. | |
| 2014/0199840 | A1 | 7/2014 | Bajaj et al. | |
| 2014/0370643 | A1 | 12/2014 | Stern et al. | |
| 2015/0162213 | A1 | 6/2015 | Chen et al. | |
| 2016/0089686 | A1 | 3/2016 | Lee et al. | |
| 2016/0141210 | A1 | 5/2016 | Lei et al. | |
| 2016/0372320 | A1 | 12/2016 | Emoto | |
| 2017/0356084 | A1 | 12/2017 | Nakanishi et al. | |
| 2018/0090352 | A1 | 3/2018 | Sotoku et al. | |
| 2018/0182634 | A1 * | 6/2018 | Smith | H01J 37/32899 |
| 2018/0226278 | A1 | 8/2018 | Arnepalli et al. | |
| 2018/0374936 | A1 | 12/2018 | Kelly et al. | |
| 2019/0011734 | A1 | 1/2019 | Otsuji | |
| 2019/0027383 | A1 | 1/2019 | Nakal et al. | |
| 2019/0148192 | A1 | 5/2019 | Yamaguchi | |
| 2019/0295856 | A1 | 9/2019 | Tahara et al. | |
| 2020/0161148 | A1 * | 5/2020 | Abel | C23F 1/08 |
| 2020/0377792 | A1 | 12/2020 | Guske et al. | |
| 2023/0118554 | A1 | 4/2023 | Abel | |
| 2023/0121246 | A1 | 4/2023 | Abel | |
| 2024/0010915 | A1 * | 1/2024 | Chen | C09K 13/06 |

FOREIGN PATENT DOCUMENTS

| | | |
|---|---|---|
| KR | 1020170077839 | 7/2017 |
| WO | 2014178326 | 11/2014 |
| WO | 2016041407 | 3/2016 |
| WO | 2017099718 | 6/2017 |
| WO | 2018004649 | 1/2018 |

OTHER PUBLICATIONS

International Search Report Issued in Application No. PCT/US2019/061678, Mar. 13, 2020, 8 pgs.

Microchemicals, "Basics of Microstructuring", Wet Chemical Etching of Metals, 2022, 7 pgs.

Notification Of Transmittal Of The International Search Report And The Written Opinion Of The International Searching Authority Of The Declaration; Filed Sep. 6, 2023; PCT/US2023/032072; Dec. 21, 2023, 13 pgs.

* cited by examiner

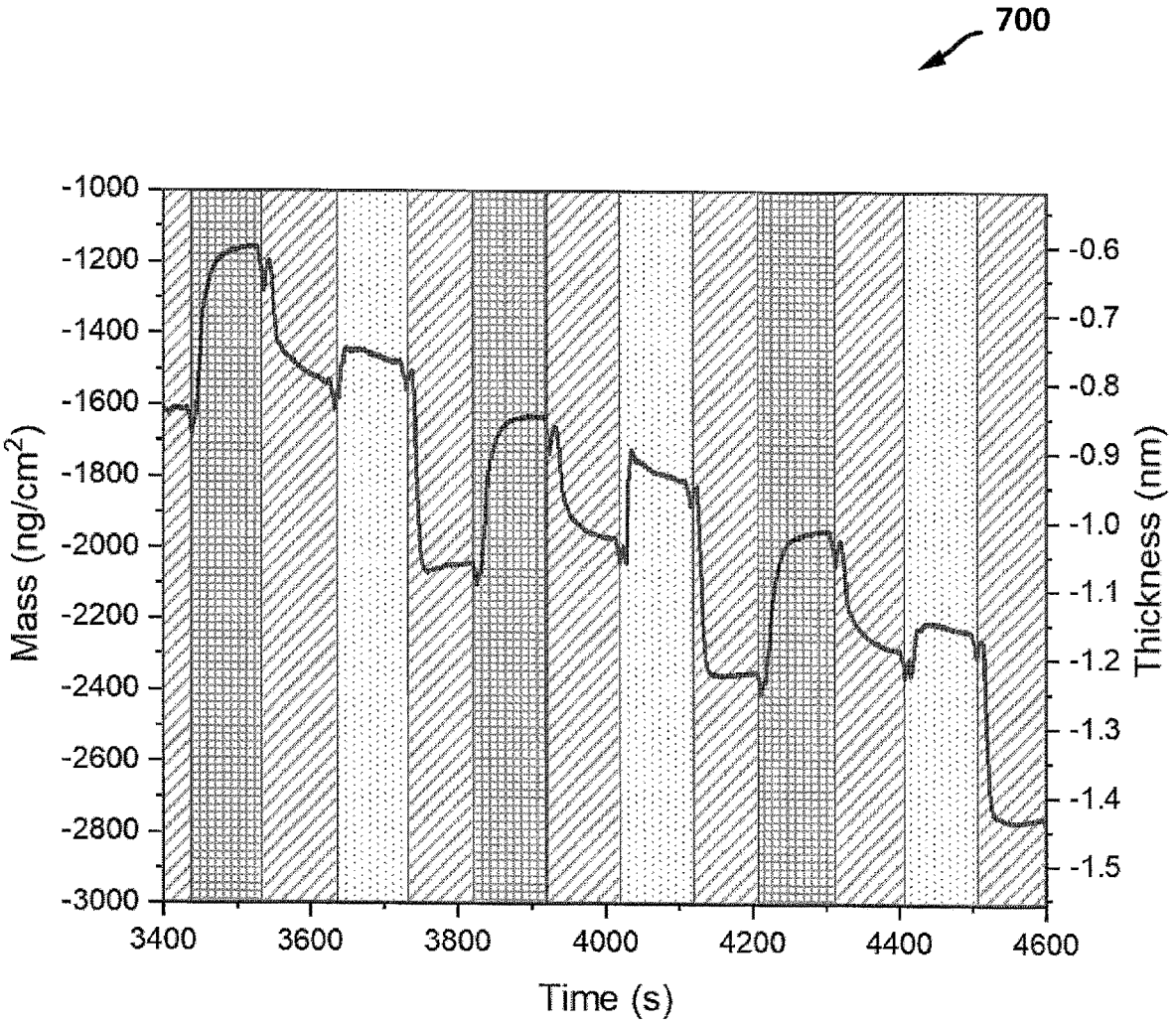
*FIG. 7A*
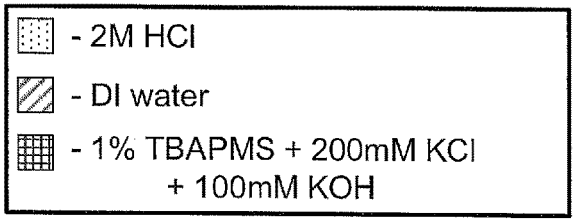

METHODS FOR WET ETCHING OF NOBLE METALS

This application is a continuation-in-part (CIP) of co-pending U.S. patent application Ser. No. 17/674,579, filed Feb. 17, 2022, entitled "METHODS FOR WET ATOMIC LAYER ETCHING OF RUTHENIUM", which claims priority to U.S. Provisional Patent Application Ser. No. 63/257,226, filed Oct. 19, 2021, entitled "METHOD FOR WET ATOMIC LAYER ETCHING OF RUTHENIUM"; the disclosures of which are expressly incorporated herein, in their entirety, by reference.

BACKGROUND

This disclosure relates to semiconductor device manufacturing, and, in particular, to the removal and etching of polycrystalline materials, such as noble metals.

During routine semiconductor fabrication, various metals formed on a substrate may be removed by patterned etching, chemical-mechanical polishing, as well as other techniques. A variety of techniques are known for etching layers on a substrate, including plasma-based or vapor phase etching (otherwise referred to as dry etching) and liquid based etching (otherwise referred to as wet etching). Wet etching generally involves dispensing a chemical solution over the surface of a substrate or immersing the substrate in the chemical solution. The chemical solution often contains a solvent, chemicals designed to react with materials on the substrate surface and chemicals to promote dissolution of the reaction products. As a result of exposure of the substrate surface to the etchant, material is removed from the substrate. Etchant composition and temperature may be controlled to control the etch rate, specificity and residual material on the surface of the substrate post-etch.

Thermodynamics and kinetics both play roles in etchant formulation. The desired reactions need to be both thermodynamically and kinetically favorable for a successful etch. The requirements for success become much more stringent for etching polycrystalline materials. For these materials, it is desirable that the removal rates for each individual crystallite facet and grain boundary geometry is substantially similar regardless or crystallite morphology or environment. Surface roughness plays an important role in interface quality and electrical properties of nanoscale features. When etching nanoscale polycrystalline materials, differing etch rates at grain boundaries compared to the different crystal facets leads to roughening of the surface during etching. Further, it is desirable that the material removal rate should be uniform at the macroscopic and microscopic levels and occurs at a rate that is compatible with high volume manufacturing. Macroscopic uniformity can be addressed with careful engineering, but microscopic uniformity depends on the chemistry of the etch itself.

As geometries of substrate structures continue to shrink and the types of structures evolve, the challenges of etching substrates have increased. One technique that has been utilized to address these challenges is atomic layer etching (ALE). ALE is a process that removes thin layers sequentially through one or more self-limiting reactions. For example, ALE typically refers to techniques that can etch with atomic precision, i.e., by removing material one monolayer (or a few monolayers) of material at a time. ALE processes generally rely on a chemical modification of the surface to be etched followed by a selective removal of the modified layer. Thus, ALE processes offer improved performance by decoupling the etch process into sequential steps of surface modification and removal of the modified surface. In some embodiments, an ALE process may include multiple cyclic series of layer modification and etch steps, where the modification step modifies the exposed surfaces and the etch step selectively removes the modified layer. In such processes, a series of self-limiting reactions may occur and the cycle may be repeatedly performed until a desired or specified etch amount is achieved. In other embodiments, an ALE process may use just one cycle.

A variety of ALE processes are known, including plasma ALE, thermal ALE and wet ALE techniques. Like all ALE processes, wet ALE is typically a cyclic process that uses sequential, self-limiting reactions to selectively remove material from the surface. Unlike thermal and plasma ALE, however, the reactions used in wet ALE primarily take place in the liquid phase. Compared to other ALE processes, wet ALE is often desirable since it can be conducted at (or near) room temperature and atmospheric pressure. Additionally, the self-limiting nature of the wet ALE process leads to smoothing of the surface during etching rather than the roughening commonly seen during other etch processes.

A wet ALE process typically begins with a surface modification step, which exposes a material to a first solution to create a self-limiting modified surface layer. The modified surface layer may be created through oxidation, reduction, ligand binding, or ligand exchange. Ideally, the modified surface layer is confined to the top monolayer of the material and acts as a passivation layer to prevent the modification reaction from progressing any further. After the modified surface layer is formed, the wet ALE process may expose the modified surface layer to a second solution to selectively dissolve the modified surface layer in a subsequent dissolution step. The dissolution step must selectively dissolve the modified surface layer without removing any of the underlying unmodified material. This selectivity can be accomplished by using a different solvent in the dissolution step than was used in the surface modification step, changing the pH, or changing the concentration of other components in the first solvent. The wet ALE cycle can be repeated until a desired or specified etch amount is achieved.

Recently, noble metals such as ruthenium (Ru), gold (Au), platinum (Pt) and iridium (Ir) have been introduced into the semiconductor manufacturing process. The nobility of these metals makes them difficult to etch. For example, strong oxidizers (such as sodium hypochlorite, ceric ammonium nitrate and periodic acid) are typically used in ruthenium etch processes to create soluble or volatile ruthenium compounds, which can be dissolved in the subsequent dissolution step. The oxidizers used to etch ruthenium pose metal contamination hazards in the subsequently formed device, are expensive (periodic acid) and typically result in a rough post-etch ruthenium surface.

Similar to ruthenium, conventional etch processes used to etch gold (Au), platinum (Pt) and iridium (Ir) typically use aggressive chemicals, such as hot aqua regia (i.e., a heated mixture of concentrated nitric acid and hydrochloric acid) or other highly oxidizing acidic solutions, to oxidize exposed Au, Pt and Ir surfaces. The highly oxidizing acid solutions required to etch Au, Pt and Ir surfaces have poor selectivity to (and thus, tend to etch) other materials present on the wafer surface. In some cases, for example, it may be desirable to etch platinum selectively to nickel silicide (NiSi). However, high selectivity of NiSi:Pt is not achievable with strongly oxidizing solutions, which tend to leach Ni out of the NiSi, leaving silicon dioxide ($SiO_2$) behind. There are also environmental and safety concerns with harsh etch chemistries. Disposal of strong acids also requires the use of neutralizers, which add cost. Aqua regia, in addition to being strongly oxidizing and acidic, outgasses toxic and polluting nitrogenous compounds such as nitrogen dioxide ($NO_2$) and nitrosyl chloride (NOCl). In addition to the disadvantages mentioned above, the difficulty in etching noble metals, such as ruthenium, gold, platinum and iridium, creates problems with post-etch surface roughness in applications that only partially etch or remove a portion of the noble metal layer. In addition, grain boundaries act as extended defect surfaces and are more reactive than grain surfaces. This difference in reactivity leads to higher etch rates at the grain boundaries and poor post-etch morphology.

New etch chemistries are needed to enable widespread adoption of noble metals, such as ruthenium, gold, platinum and iridium, within semiconductor manufacturing processes. The new etch chemistries developed for etching noble metals are preferably metal-free, cost-effective and effective at solubilizing the noble metal, while also being selective to other materials present on the wafer surface.

SUMMARY

The present disclosure provides improved wet etch processes and methods for etching noble metals. More specifically, the present disclosure provides various embodiments of wet etch processes and methods that utilize new etch chemistries for etching noble metals, such as ruthenium (Ru), gold (Au), platinum (Pt) and iridium (Ir), in a wet etch process. As described in more detail below, the embodiments described herein expose a noble metal surface to a first etch solution to chemically modify the noble metal surface and form a noble metal salt passivation layer, which can be selectively dissolved in a second etch solution to etch the noble metal surface. The first etch solution may generally include one or more oxidizers and a cation source. The oxidizers utilized within the first etch solution preferably include a persulfate salt and a chloride ion source.

When a substrate having a noble metal surface is exposed to a first etch solution that combines a persulfate salt with a chloride ion source, sulfate radicals within the persulfate salt react with chloride ions ($Cl^-$) within the chloride ion source to form dichloride radical ions ($Cl_2^{\bullet-}$). The dichloride radical ions ($Cl_2^{\bullet-}$) oxidize the noble metal surface to form the noble metal salt passivation layer, which may be soluble or insoluble in the first etch solution. When the first etch solution is an aqueous solution, the noble metal salt passivation layer formed during the oxidation process may be a chloro-metalate salt, an oxychlorometalate salt or a hydrate of these salts. In some embodiments, the identity and solubility of the noble metal salt species formed during the oxidation process can be controlled by adjusting the pH, the ionic strength and/or the concentration and identity of the cations used in the first etch solution. Adjusting these parameters can lead to forming either: (a) noble metal salt species that are soluble within the first etch solution, which leads to a continuous oxidation process, or (b) noble metal salt species that are insoluble within the first etch solution, which leads to a self-limiting oxidation process. When self-limiting noble metal salt species are formed, the noble metal salt passivation layer can be selectively dissolved in a second etch solution, leading to a wet atomic layer etch (ALE) process.

According to one embodiment, a method of etching is provided that utilizes the techniques described herein to etch noble metals. The method may generally include receiving a substrate having a noble metal formed thereon, wherein a noble metal surface is exposed on a surface of the substrate, and exposing the surface of the substrate to a surface modification solution such that the surface modification solution is in contact with the noble metal surface. In this embodiment, the surface modification solution may generally include a persulfate salt, a chloride ion source and a cation. The persulfate salt reacts with the chloride ion source to form dichloride radical ions, which oxidize the noble metal surface to form a noble metal salt passivation layer. In some embodiments, the noble metal salt passivation layer is a chloro-metalate salt, an oxychlorometalate salt, or a hydrate of the chloro-metalate salt or the oxychlorometalate salt. Next, the method may include removing the surface modification solution from the surface of the substrate subsequent to forming the noble metal salt passivation layer, and exposing the surface of the substrate to a dissolution solution that reacts with the noble metal salt passivation layer to form soluble species that are dissolved by the dissolution solution. Next, the method may include removing the dissolution solution and the soluble species from the substrate.

The method described above may generally be used to etch a variety of noble metals including, but not limited to, ruthenium (Ru), gold (Au), platinum (Pt) or iridium (Ir). A variety of different etch chemistries may be used in the surface modification solution and the dissolution solution, depending on the noble metal being etched.

For example, the surface modification solution may generally include a persulfate salt, a chloride ion source and a cation. In some embodiments, the persulfate salt may be an ammonium or quaternary ammonium cation salt of the persulfate or peroxymonosulfate ion (such as, e.g., APS, TBAPMS or OXONE™). In some embodiments, the chloride ion source may be an acidic chloride ion source, such as hydrochloric acid (HCl), or a non-acidic chloride ion source selected from a group comprising soluble metal chlorides, ammonium chlorides, imidazolium chlorides, and chloride salts of phosphoniums, pyrrolidiniums, guanidiniums, triazoliums, quinoliniums and other organic cations. In example embodiments, the non-acidic chloride ion source may be potassium chloride (KCl), tetrabutylammonium chloride (TBAC), tetramethyl ammonium chloride (TMAC) and/or 1-butyl-3-methylimidazolium chloride.

The dissolution solution may include an aqueous dissolution solution or a solvent. In some embodiments, the dissolution solution may be an aqueous dissolution solution containing an acid selected from a group comprising of hydrochloric acid (HCl), nitric acid and sulfuric acid. In other embodiments, the dissolution solution may be a solvent selected from a group comprising of deionized water, acetonitrile, alcohols, acetates, ethers and ketones.

In one example embodiment, the surface modification solution may include: (a) ammonium persulfate (APS) or tetrabutylammonium peroxymonosulfate (TBAPMS) as the persulfate salt, and (b) tetrabutylammonium chloride (TBAC) as the chloride ion source. In such an embodiment, exposing the surface of the substrate to the surface modification solution may oxidize the noble metal surface and form the noble metal salt passivation layer in a continuous oxidation process.

In another example embodiment, the surface modification solution may include: (a) ammonium persulfate (APS) or tetrabutylammonium peroxymonosulfate (TBAPMS) as the persulfate salt, (b) potassium chloride (KCl) as the chloride ion source, and (c) a base. In such an embodiment, exposing the surface of the substrate to the surface modification solution may oxidize the noble metal surface and form the noble metal salt passivation layer in a self-limiting oxidation process.

In yet another example embodiment, the surface modification solution may include: (a) ammonium persulfate (APS) or tetrabutylammonium peroxymonosulfate (TBAPMS) as the persulfate salt, and (b) hydrochloric acid (HCl) as the chloride ion source. In such an embodiment, exposing the surface of the substrate to the surface modification solution may oxidize the noble metal surface and form the noble metal salt passivation layer in a self-limiting oxidation process.

According to another embodiment, another method of etching is provided that utilizes the techniques described herein to etch noble metals. The method may generally include receiving a substrate having a noble metal formed thereon, wherein a noble metal surface is exposed on a surface of the substrate, and exposing the surface of the substrate to a surface modification solution such that the surface modification solution is in contact with the noble metal surface. In this embodiment, the surface modification solution may generally include: (a) a chloride ion source, (b) a persulfate salt that reacts with the chloride ion source to form dichloride radical ions, which oxidize the noble metal surface to form a noble metal salt passivation layer, and (c) an acid or a base to adjust a pH of the surface modification solution and control an oxidation behavior of the noble metal salt passivation layer. In some embodiments, the noble metal salt passivation layer is a chloro-metalate salt, an oxychlorometalate salt, or a hydrate of the chloro-metalate salt or the oxychlorometalate salt. Next, the method may include removing the surface modification solution from the surface of the substrate subsequent to forming the noble metal salt passivation layer, and exposing the surface of the substrate to a dissolution solution that reacts with the noble metal salt passivation layer to form soluble species that are dissolved by the dissolution solution. Next, the method may include removing the dissolution solution and the soluble species from the substrate.

The method described above may generally be used to etch a variety of noble metals including, but not limited to, ruthenium (Ru), gold (Au), platinum (Pt) or iridium (Ir). A variety of different etch chemistries may be used in the surface modification solution, depending on the noble metal being etched and the desired oxidation behavior. For example, the surface modification solution may generally include an ammonium or quaternary ammonium cation salt of the persulfate or peroxymonosulfate ion (such as, e.g., APS, TBAPMS or OXONE™) as the persulfate salt. The surface modification solution may further include a non-acidic chloride ion source or an acidic chloride ion source and the acid or the base to control the oxidation behavior of the noble metal salt passivation layer.

In some embodiments, the surface modification solution may further include a non-acidic chloride ion source and the acid. In such embodiments, the acid may decrease the pH of the surface modification solution to oxidize the noble metal surface and form the noble metal salt passivation layer in a continuous oxidation process. In one example implementation, the surface modification solution may include tetrabutylammonium chloride (TBAC) as the non-acidic chloride ion source, tetrabutylammonium peroxymonosulfate (TBAPMS) as the persulfate salt, and hydrochloric acid (HCl) as the acid.

In other embodiments, the surface modification solution may further include a non-acidic chloride ion source and the base. In such embodiments, the base may increase the pH of the of the surface modification solution to oxidize the noble metal surface and form the noble metal passivation layer in a self-limiting oxidation process. In one example implementation, the surface modification solution may include potassium chloride (KCl) as the non-acidic chloride ion source, tetrabutylammonium peroxymonosulfate (TBAPMS) as the persulfate salt, and potassium hydroxide (KOH) as the base.

In yet other embodiments, the surface modification solution may further include an acidic chloride ion source as the chloride ion source and the acid. In such embodiments, the acidic chloride ion source may change a ratio of cations in the surface modification solution to oxidize the noble metal surface and form the noble metal salt passivation layer in a self-limiting oxidation process. In one example implementation, the surface modification solution may include tetrabutylammonium peroxymonosulfate (TBAPMS) as the persulfate salt and hydrochloric acid (HCl) as the acidic chloride ion source.

According to yet another embodiment, a method of etching a substrate using a wet atomic layer etching (ALE) process is provided herein to etch noble metals. The method may generally include: a) receiving the substrate, the substrate having a noble metal layer thereon; b) exposing the noble metal layer to a first etch solution containing a non-acidic chloride ion source, a base and an oxidizer that reacts with the non-acidic chloride ion source to form dichloride radical ions, which oxidize the noble metal surface to form a chemically modified noble metal surface layer containing a chloro-metalate salt, an oxychlorometalate salt or a hydrate of the chloro-metalate salt or the oxychlorometalate salt, which is self-limiting and insoluble in the first etch solution; c) rinsing the substrate with a first purge solution to remove the first etch solution from a surface of the substrate; d) exposing the chemically modified noble metal surface layer to a second etch solution to dissolve the chemically modified noble metal surface layer; e) rinsing the substrate with a second purge solution to remove the second etch solution from the surface of the substrate; and f) repeating steps b)-e) for one or more cycles.

A wide variety of etch chemistries may be used in the first etch solution and the second solution, depending on the noble metal being etched. The chloro-metalate salt, the oxychlorometalate salt or the hydrate of the chloro-metalate salt or the oxychlorometalate salt may be insoluble in the first etch solution and soluble in the second etch solution.

In some embodiments, the first etch solution may include potassium chloride (KCl) as the non-acidic chloride ion source, potassium hydroxide (KOH) as the base, and ammonium persulfate (APS) or tetrabutylammonium peroxymonosulfate (TBAPMS) as the oxidizer.

In some embodiments, the first etch solution may be a basic aqueous oxidizing solution having a pH value greater than 7. In such embodiments, said b) exposing the noble metal layer to the first etch solution may at least partially hydrolyze the chloro-metalate salt, the oxychlorometalate salt or the hydrate of the chloro-metalate salt or the oxychlorometalate salt to a noble metal oxide, hydroxide or salt hydrate layer, which is insoluble in the first etch solution, yet soluble within the second etch solution.

In some embodiments, the second etch solution may be an acidic dissolution solution. In such embodiments, said d) exposing the chemically modified noble metal surface layer to the second etch solution may dissolve the noble metal oxide, hydroxide or salt hydrate layer and re-chlorinate any remaining noble metal oxide, hydroxide or salt hydrate layer into the chloro-metalate salt, the oxychlorometalate salt or the hydrate of the chloro-metalate salt or the oxychlorometalate salt. The chloro-metalate salt, the oxychlorometalate salt or the hydrate of the chloro-metalate salt or the oxychlorometalate salt may be insoluble in the first etch solution and soluble in the second etch solution and the second purge solution.

Note that this summary section does not specify every embodiment and/or incrementally novel aspect of the present disclosure or claimed invention. Instead, this summary only provides a preliminary discussion of different embodiments and corresponding points of novelty over conventional techniques. For additional details and/or possible perspectives of the invention and embodiments, the reader is directed to the Detailed Description section and corresponding figures of the present disclosure as further discussed below.

BRIEF DESCRIPTION OF THE DRAWINGS

A more complete understanding of the present inventions and advantages thereof may be acquired by referring to the following description taken in conjunction with the accompanying drawings, in which like reference numbers indicate like features. It is to be noted, however, that the accompanying drawings illustrate only exemplary embodiments of the disclosed concepts and are therefore not to be considered limiting of the scope, for the disclosed concepts may admit to other equally effective embodiments.

FIG. 7A is a graph of QCM data obtained from a gold surface etched in a cyclic wet ALE etch experiment, where the data illustrates a self-limited etch behavior.

DETAILED DESCRIPTION

Figure 1:
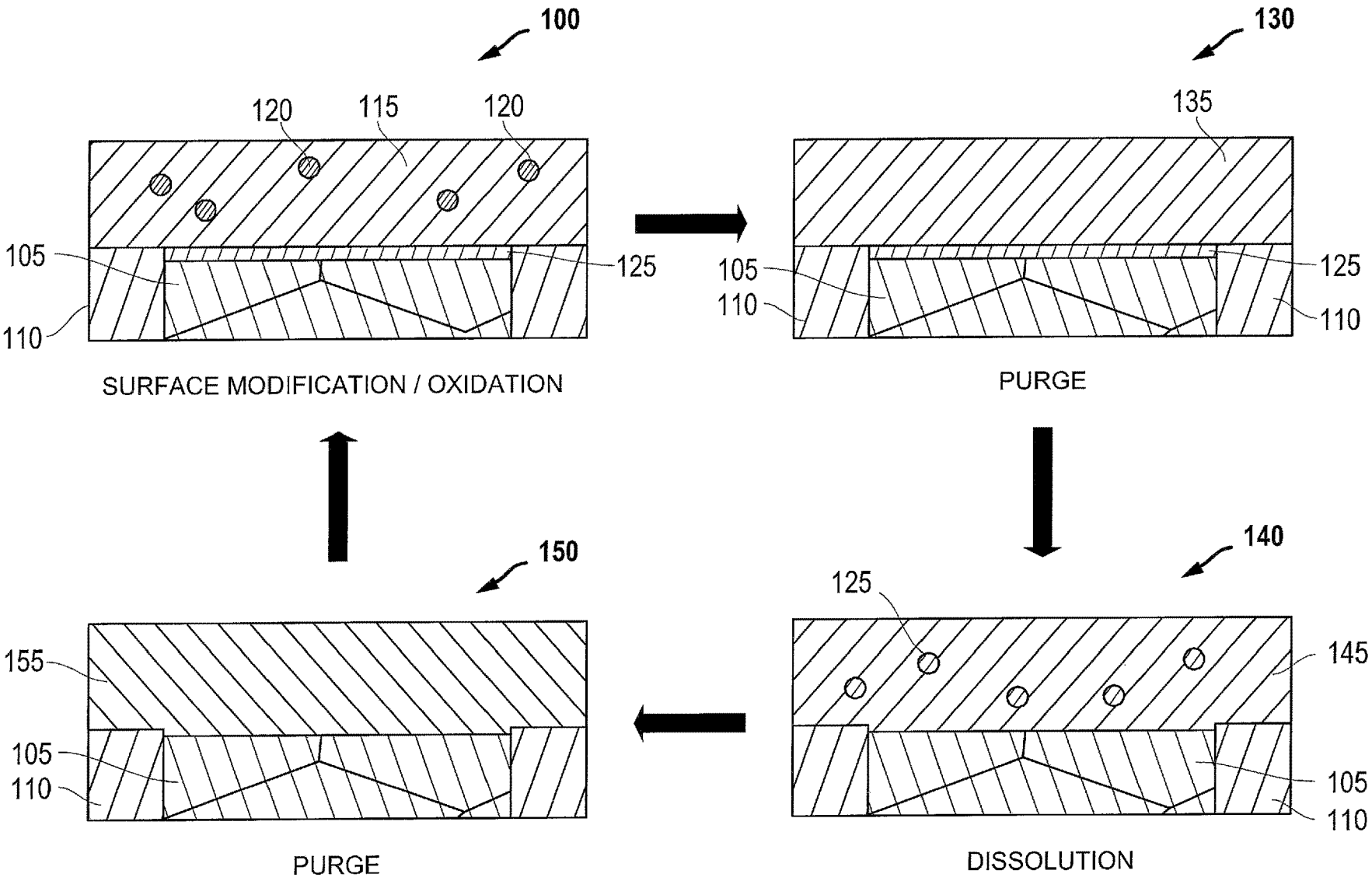
FIG. 1 is a block diagram illustrating one example of a cyclic wet atomic layer etching (ALE) process that can be used to etch a noble metal surface in accordance with the present disclosure.

The present disclosure provides improved wet etch processes and methods for etching noble metals. More specifically, the present disclosure provides various embodiments of wet etch processes and methods that utilize new etch chemistries for etching noble metals, such as ruthenium (Ru), gold (Au), platinum (Pt) and iridium (Ir), in a wet etch process. As described in more detail below, the embodiments described herein expose a noble metal surface to a first etch solution to chemically modify the noble metal surface and form a noble metal salt passivation layer, which can be selectively dissolved in a second etch solution to etch the noble metal surface. The first etch solution may generally include one or more oxidizers and a cation source. However, the oxidizers utilized within the first etch solution preferably include a persulfate salt and a chloride ion source.

When a substrate having a noble metal surface is exposed to a first etch solution that combines a persulfate salt with a chloride ion source, sulfate radicals within the persulfate salt react with chloride ions ($Cl^-$) within the chloride ion source to form dichloride radical ions ($Cl_2^{\bullet-}$). The dichloride radical ions ($Cl_2^{\bullet-}$) oxidize the noble metal surface to form a noble metal salt passivation, which may be soluble or insoluble in the first etch solution. When the first etch solution is an aqueous solution, the noble metal salt passivation layer formed during the oxidation process may be a chloro-metalate salt, an oxychlorometalate salt or a hydrate of these salts. In some embodiments, a soluble noble metal salt species may be formed, resulting in a continuous oxidation process. In other embodiments, the noble metal salt species may be unstable in the first etch solution and may at least partially hydrolyze to a noble metal oxide, hydroxide or salt hydrate layer, which is insoluble within the first etch solution. The formation of an insoluble noble metal oxide, hydroxide or salt hydrate layer may lead to a self-limiting oxidation process.

In some embodiments, the oxidation behavior of the noble metal surface and the solubility of the noble metal salt species formed during the oxidation process can be controlled by adjusting the pH, the ionic strength and/or the concentration and identity of the cations used in the first etch solution. Adjusting these parameters can lead to forming either: (a) soluble noble metal salt species, which are soluble within the first etch solution and lead to a continuous oxidation process, or (b) insoluble noble metal salt species, which are insoluble within the first etch solution and lead to a self-limiting oxidation process. When insoluble noble metal salt species are formed, the etch amount is controlled by the extent of oxidation even though the oxidation product (e.g., the chloro-metalate salt species or the oxychlorometalate salt species) are not removed until the dissolution step. When insoluble, self-limiting noble metal salt species are formed, the noble metal salt passivation layer can be selectively dissolved in a second etch solution, leading to a wet atomic layer etch (ALE) process.

The techniques described herein may be generally used to etch noble metals, such as but not limited to, ruthenium, gold, platinum or iridium. The polycrystalline nature of noble metals makes it susceptible to pitting if an etchant preferentially attacks the grain boundaries. Etchant chemistry should, at a minimum, leave the surface no rougher than it was initially and ideally improve the surface roughness during etching. Acceptable surface morphology can be accomplished through the formation of a self-limiting noble metal salt passivation layer (e.g., a chloro-metalate salt passivation layer or an oxychlorometalate salt passivation layer) that is selectively removed in a cyclic wet ALE process. Although a cyclic wet ALE process may be preferred in some embodiments, the techniques described herein may also be utilized to etch noble metals in a continuous etch process. Since etch rates tend to be higher in a continuous etch process vs a self-limiting etch process, a continuous etch process may be preferred in applications that completely strip or remove the noble metal layer.

The techniques described herein offer multiple advantages over conventional methods used for etching noble metals. For example, the wet etch processes and methods described herein preferably utilize etch chemistries that are metal-free, cost-effective and improve surface roughness during etching. In some embodiments, the techniques described herein may also provide the benefits of ALE (such as, e.g., precise control of total etch amount, control of surface roughness, and improvements in wafer-scale uniformity) and wet etching (such as, e.g., such as the simplicity of the etch chamber, atmospheric temperature and pressure etching conditions). As such, the techniques described herein may provide a unique method for etching noble metals.

In some embodiments of the present disclosure, the techniques described herein may be used to etch a noble metal surface by performing one or more cycles of a wet ALE process, where each cycle includes a surface modification step and a dissolution step. In the surface modification step, the noble metal surface may be exposed to a surface modification solution to chemically modify the noble metal surface and form a modified surface layer (e.g., a noble metal salt passivation layer and/or a noble metal oxide layer). In the dissolution step, the modified surface layer may be selectively removed by exposing the modified surface layer to a dissolution solution to dissolve the modified surface layer. Purge steps may be performed between the surface modification and dissolution steps to prevent the surface modification and dissolution solutions from mixing, and the process may be repeated in a cyclic manner until a desired amount of etching is achieved.

FIG. 1 illustrates one example of a wet ALE process in accordance with the present disclosure. More specifically, FIG. 1 illustrates exemplary steps performed during one cycle of a wet ALE process. In the process shown in FIG. 1, a polycrystalline material 105 surrounded by a dielectric material 110 is brought in contact with a surface modification solution 115 during a surface modification step 100 to modify an exposed surface of the polycrystalline material 105 and form a modified surface layer 125. The exposed surface of the polycrystalline material 105 to be etched is preferably a noble metal surface, such as but not limited to, a ruthenium (Ru), gold (Au), platinum (Pt) or iridium (Ir) surface. Other noble metals may also be etched using the wet ALE process shown in FIG. 1.

In the wet ALE process shown in FIG. 1, the surface modification solution 115 includes a chlorination agent 120 dissolved in a first solvent (e.g., an aqueous solvent, such as deionized water). The chlorination agent 120 may generally include a combination of oxidizers. For example, the chlorination agent 120 may include a persulfate salt (e.g., an oxidizer) and a chloride ion source (e.g., a co-oxidizer). Although a persulfate salt is utilized as an oxidizer, the exposed surface of the polycrystalline material 105 (i.e., the noble metal surface) is not oxidized by the persulfate salt alone. Instead, the persulfate salt reacts with the chloride ion source to form dichloride radical ions, which oxidize the noble metal surface to form the modified surface layer 125.

A wide variety of chemicals may be used within the surface modification solution 115, depending on the noble metal surface to be etched and the desired oxidation behavior. For example, the chloride ion source included within the surface modification solution 115 may be an acidic chloride ion source (e.g., hydrochloric acid (HCl)), in some embodiments. In other embodiments, the chloride ion source may be a non-acidic chloride ion source, such as a chloride salt. Examples of chloride salts include, but are not limited to, soluble metal chlorides, such as potassium chloride (KCl); ammonium chloride or other tetraalkylammonium chlorides, such as tetrabutylammonium chloride (TBAC) and tetramethyl ammonium chloride (TMAC); imidazolium chlorides, such as 1-butyl-3-methylimidazolium chloride; and chloride salts of phosphoniums, pyrrolidiniums, guanidiniums, triazoliums, quinoliniums, or any other organic cation.

The persulfate salt included within the surface modification solution 115 may be an ammonium, sodium or potassium cation salt of the persulfate or peroxymonosulfate ion. Although a variety of persulfate salts may be used, ammonium or quaternary ammonium cation salts of the persulfate or peroxymonosulfate ion are generally preferred, since they are metal-free and do not pose a metal contamination risk for semiconductor processing. Examples of ammonium or quaternary ammonium cation salts of the persulfate or peroxymonosulfate ion include, but are not limited to, ammonium persulfate (APS), tetrabutylammonium peroxymonosulfate (TBAPMS), and OXONE™, which is a tri-salt mixture of TBAPMS, tetrabutylammonium sulfate (TBAS) and tetrabutylammonium hydrogen sulfate (TBAHS).

In some embodiments, a base may be added to the surface modification solution 115 to raise the pH of the surface modification solution 115 (e.g., to a pH level above 7.0), thereby providing a basic oxidizing solution. Examples of bases that may be added to the surface modification solution 115 include, but are not limited to, potassium hydroxide (KOH), ammonium hydroxide or tetraalkylammonium hydroxides, such as tetramethylammonium hydroxide (TMAH) or tetrabutylammonium hydroxide (TBAH), etc.

When the exposed surface of the polycrystalline material 105 is exposed to the surface modification solution 115 in the surface modification step 100, a chemical reaction occurs at the exposed surface of the polycrystalline material 105 to oxidize the exposed surface and form a modified surface layer 125. When the exposed surface of the polycrystalline material 105 is exposed to a surface modification solution 115 including a persulfate salt and a chloride ion source, sulfate radicals within the persulfate salt react with chloride ions ($Cl^-$) within the chloride ion source to form dichloride radical ions ($Cl_2^{\bullet-}$). The dichloride radical ions ($Cl_2^{\bullet-}$)

oxidize the exposed surface of the polycrystalline material 105 to form a noble metal salt passivation layer, which is soluble in the surface modification solution 115. The noble metal salt passivation layer may be a chloro-metalate salt, an oxychlorometalate salt or a hydrate of these salts.

Wet ALE etch processes require a self-limiting passivation layer to be formed on the exposed surface of the polycrystalline material 105 (i.e., on the noble metal surface). The formation of this passivation layer is accomplished by exposing the noble metal surface to a first etch solution (i.e., surface modification solution 115) that enables or causes a chemical reaction between the species in solution and the noble metal surface. The self-limiting passivation layer must be insoluble in the solution used for its formation (i.e., surface modification solution 115), but freely soluble in the second etch solution (i.e., dissolution solution 145) used for its dissolution.

In some embodiments, a self-limiting passivation layer may be formed in the surface modification step 100 by exposing the noble metal surface to a surface modification solution 115 that includes a persulfate salt, a non-acidic chloride ion source (e.g., a chloride salt) and a base. When a persulfate salt is combined with a non-acidic chloride ion source and a base, the chemical reaction that occurs at the exposed surface of the polycrystalline material 105 to oxidize the exposed surface and form the modified surface layer 125 may form a noble metal salt passivation layer (e.g., a chloro-metalate salt, an oxychlorometalate salt or a hydrate of these salts), which is soluble in the surface modification solution 115. However, because the noble metal salt passivation layer is unstable under basic conditions, the noble metal salt passivation layer may at least partially hydrolyze to a noble metal oxide, hydroxide or salt hydrate layer, which is insoluble within the surface modification solution 115. The formation of an insoluble noble metal oxide, hydroxide or salt hydrate layer results in a self-limiting passivation layer on the exposed surface of the polycrystalline material 105 (i.e., the noble metal surface).

Thus, adding a base to the surface modification solution 115 raises the pH of the surface modification solution 115 (e.g., to a pH level above 7.0) and provides a basic oxidizing solution, which leads to self-limiting oxidation of the exposed surface of the polycrystalline material 105. This self-limiting oxidation may modify one or more monolayers of the exposed surface of the polycrystalline material 105 to form the modified surface layer 125, while preventing any further reaction between the surface modification solution 115 and the underlying surface. To maintain self-limiting oxidation behavior, neither the polycrystalline material 105 to be etched, nor the noble metal oxide layer, can be soluble in the surface modification solution 115. In some cases, the surface modification step 100 shown in FIG. 1 may continue until the surface reaction is driven to saturation.

After the modified surface layer 125 is formed, the substrate may be rinsed with a first purge solution 135 to remove excess reactants from the surface of the substrate in a first purge step 130. The first purge solution 135 should not react with the modified surface layer 125 or with the reagents present in the surface modification solution 115. In some embodiments, the first purge solution 135 used in the first purge step 130 may use the same solvent (e.g., an aqueous solvent, such as deionized water) used in the surface modification step 100. In other embodiments, a different solvent may be used in the first purge solution 135. In some embodiments, the first purge step 130 may be long enough to completely remove all excess reactants from the substrate surface.

Once rinsed, a dissolution step 140 is performed to selectively remove the modified surface layer 125. In the dissolution step 140, the modified surface layer 125 is exposed to a dissolution solution 145 to selectively remove or dissolve the modified surface layer 125 without removing the unmodified polycrystalline material 105 underlying the modified surface layer 125. The modified surface layer 125 must be soluble in the dissolution solution 145, while the unmodified polycrystalline material 105 underlying the modified surface layer 125 must be insoluble. The solubility of the modified surface layer 125 allows its removal through dissolution into the bulk dissolution solution 145. In some embodiments, the dissolution step 140 may continue until the modified surface layer 125 is completely dissolved.

A wide variety of dissolution solutions 145 may be used in the dissolution step 140, depending on the surface modification solution 115 used during the surface modification step 100 and/or the modified surface layer 125 formed. In some embodiments, the dissolution solution 145 may be an aqueous dissolution solution containing an acid, such as HCl. In other embodiments, the dissolution solution 145 may be a solvent. In some cases, the solvent utilized within the dissolution solution 145 may be a second solvent (e.g., acetonitrile), which is different from the first solvent (e.g., deionized water) used in the surface modification solution 115. In other cases, the dissolution solution 145 and the surface modification solution 115 may utilize the same solvent (e.g., deionized water). In some embodiments, ligands may be added to the dissolution solution 145 to help induce dissolution of the modified surface layer 125.

Once the modified surface layer 125 is dissolved, the ALE etch cycle shown in FIG. 1 may be completed by performing a second purge step 150. The second purge step 150 may be performed by rinsing the surface of the substrate with a second purge solution 155, which may be the same or different than the first purge solution 135. In some embodiments, second purge solution 155 may use the same solvent, which was used in the dissolution solution 145. The second purge step 150 may generally continue until the dissolution solution 145 and/or the reactants contained with the dissolution solution 145 are completely removed from the surface of the substrate.

As described above, the cyclic wet ALE process shown in FIG. 1 may generally include: a) a surface modification step 100 to chemically modify exposed surfaces of a polycrystalline material 105 by exposing the exposed surfaces of the polycrystalline material 105 to a surface modification solution 115 to form a modified surface layer 125; b) a first purge step 130 to rinse the substrate with a first purge solution 135 to remove excess reactants from the surface; c) a dissolution step 140 to selectively remove or dissolve the modified surface layer 125 by exposing the modified surface layer to a dissolution solution 145 to selectively remove the modified surface layer 125; and d) a second purge step 150 to rinse the substrate with a second purge solution 155 and displace the dissolution solution 145 from the surface of the substrate. In some embodiments, the steps a)-d) may be repeated for one or more ALE cycles, until a desired amount of the polycrystalline material 105 has been removed. It is recognized that the cyclic wet ALE process shown in FIG. 1 is merely one example of an etch process that may be used to etch a polycrystalline material 105, such as a noble metal.

The present disclosure contemplates a wide variety of etch chemistries that may be used in the surface modification solution 115 and the dissolution solution 145 when etching noble metals using the wet ALE process shown in FIG. 1. Example etch chemistries are discussed in more detail below for etching various noble metals. In some embodiments, mixing of the surface modification solution 115 and the dissolution solution 145 may lead to a continuous etch process, loss of control of the etch and roughening of the post-etch surface, all of which may undermine the benefits of wet ALE. To avoid continuous etching, purge steps 130 and 150 may be performed in the wet ALE process shown in FIG. 1 to prevent direct contact between the surface modification solution 115 and the dissolution solution 145 on the substrate surface.

The wet ALE process shown in FIG. 1 may be utilized for etching a wide variety of noble metals including, but not limited to, ruthenium (Ru), gold (Au), platinum (Pt) and iridium (Ir). Other noble metals and polycrystalline materials, which are resistant to oxidation by persulfate salts alone, may also be etched using the wet ALE process shown in FIG. 1.

In some embodiments, the wet ALE process shown in FIG. 1 may be utilized for etching ruthenium. Example etch chemistries for etching ruthenium in a wet ALE process are disclosed in co-pending U.S. patent application Ser. No. 17/674,579, the disclosure of which is incorporated herein in its entirety.

As noted in the co-pending application, one etch chemistry used for ruthenium wet ALE may form a self-limiting ruthenate salt or a perruthenate salt passivation layer during the surface modification step 100. In some embodiments, a ruthenate salt or a perruthenate salt passivation layer may be formed during the surface modification step 100 by exposing the ruthenium surface to an oxidizing solution containing an oxidizer, an appropriate cation and a chlorine source, which is reactive to ruthenium, such as concentrated hydrochloric acid (HCl). The oxidation of ruthenium in an HCl solution leads to the formation of a ruthenium salt passivation layer containing $RuO_xCl_y^{z-}$ polyanions. The HCl acts as a mild reducing agent and limits the final oxidation state of the ruthenium. Thus, the ruthenium species formed on the surface can be controlled by the concentration of HCl in the oxidizing solution. Additionally, the solubility of the ruthenium salt can be controlled by the counter-ion coordinating with the ruthenium polyanion in the salt. Thus, the solubility of the ruthenium salt passivation layer can be controlled by the HCl concentration, as well as the cations present in the oxidizing solution.

After the insoluble ruthenium salt passivation layer is formed on the ruthenium surface, it can be removed in one of two ways—e.g., via solvent exchange or ion exchange—in a subsequently performed dissolution step 140. For example, the insoluble salt can be dissolved in a pure solvent in a dissolution step that utilizes solvent exchange, or the insoluble salt can be removed through a salt metathesis reaction where the cation is exchanged to improve the solubility of the ruthenium salt in aqueous solution (e.g., ion exchange method). A diagram of this salt-mediated wet ALE process is shown in FIG. 2.

Figure 2:
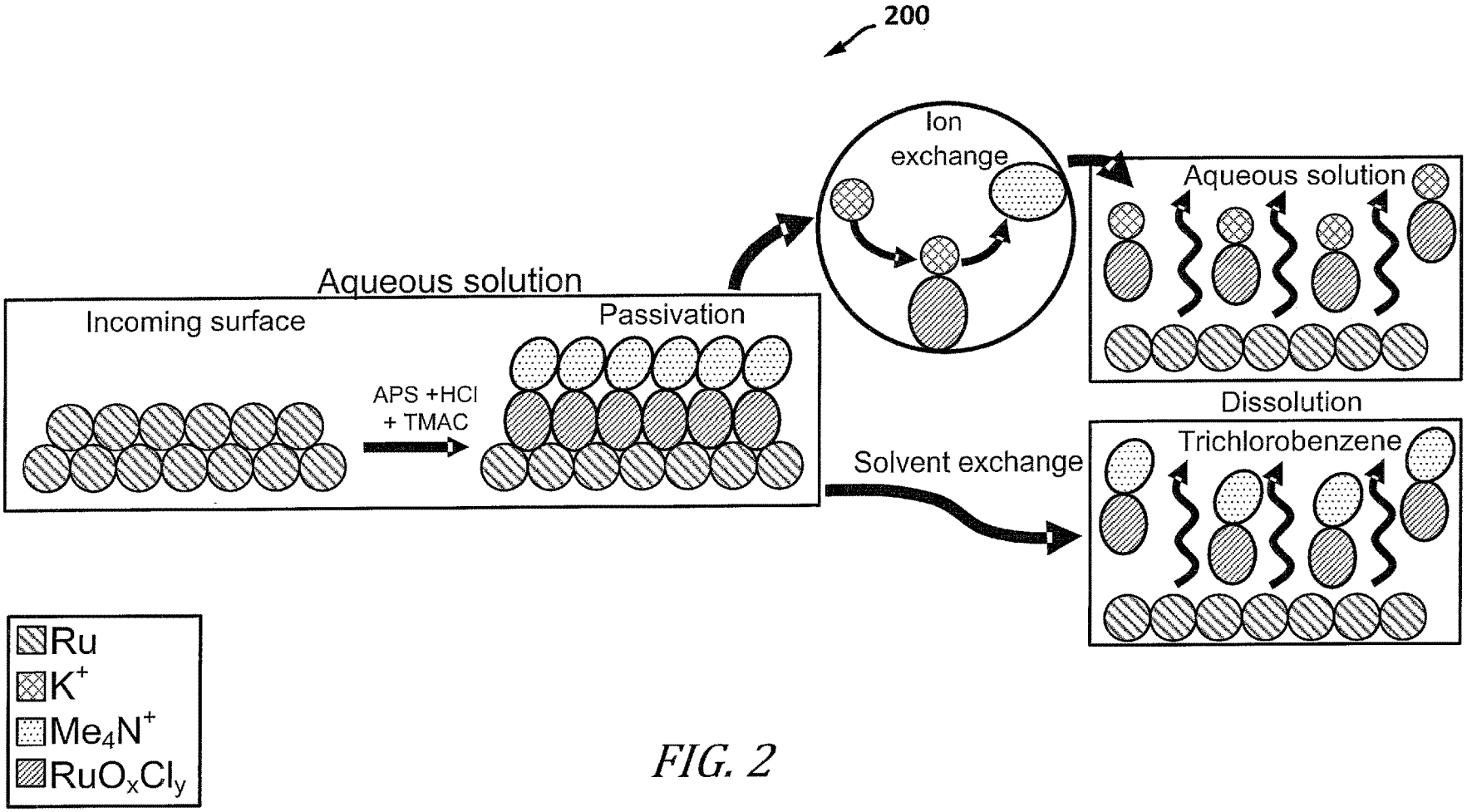
FIG. 2 illustrates one example of a salt-mediated wet ALE process that can be used to etch ruthenium (Ru) in accordance with the present disclosure.

In the example salt-mediated wet ALE process 200 shown in FIG. 2, the ruthenium surface is exposed to an aqueous oxidizing solution containing ammonium persulfate (APS) as an oxidizer and concentrated hydrochloric acid (HCl) as the chloride ion source. Although APS is used as an oxidizer in the example shown in FIG. 2, other persulfate salts such as tetrabutylammonium peroxymonosulfate (TBAPMS) or OXONE™ can also be used. In the example shown in FIG. 2, a salt such as tetramethyl ammonium chloride (TMAC) or 1-butyl-3-methylimidazolium chloride is present in the aqueous oxidizing solution to provide the cations needed for the ruthenium salt formation. The stability of the ruthenium salt passivation layer is generally dependent on the HCl concentration and the cation species. In one example experiment, a stable ruthenium salt passivation layer was formed with an HCl concentration of 6 M, and using TMAC as the salt species. The ruthenium salt passivation layer formed during the example experiment was insoluble within the aqueous oxidizing solution.

The insoluble ruthenium salt passivation layer formed on the ruthenium surface can be removed via solvent exchange or ion exchange. In the solvent exchange dissolution method, the insoluble ruthenium salt passivation layer can be dissolved in a pure solvent. In the example process 200 shown in FIG. 2, the insoluble ruthenium salt passivation layer is dissolved in trichlorobenzene. Other solvents may also be used. In the ion exchange dissolution method, the insoluble ruthenium salt passivation layer can be removed by using ion exchange to improve the solubility of the ruthenium salt passivation layer in the aqueous oxidizing solution used to form the ruthenium salt passivation layer. In the example process 200 shown in FIG. 2, for example, the ruthenium salt passivation layer can be removed from the ruthenium surface by exchanging the $Me_4N+$ cations with K+ cations. This ion exchange improves the solubility of the ruthenium salt passivation layer, so that it can be dissolved within the aqueous dissolution solution.

FIGS. 3A-3D show quartz crystal microbalance (QCM) data obtained from ruthenium wet ALE experiments where a ruthenium surface is oxidized using an aqueous solution of APS, HCl and a chloride salt (e.g., tetrabutylammonium chloride, TBAC) to form a ruthenium salt passivation layer, which is subsequently dissolved in an aqueous solution of KOH and KCl. The graphs shown in FIGS. 3A-3D illustrate ruthenium etch behavior for a variety of oxidizer concentrations, HCl concentrations and cation species during the etch process.

Figure 3A:
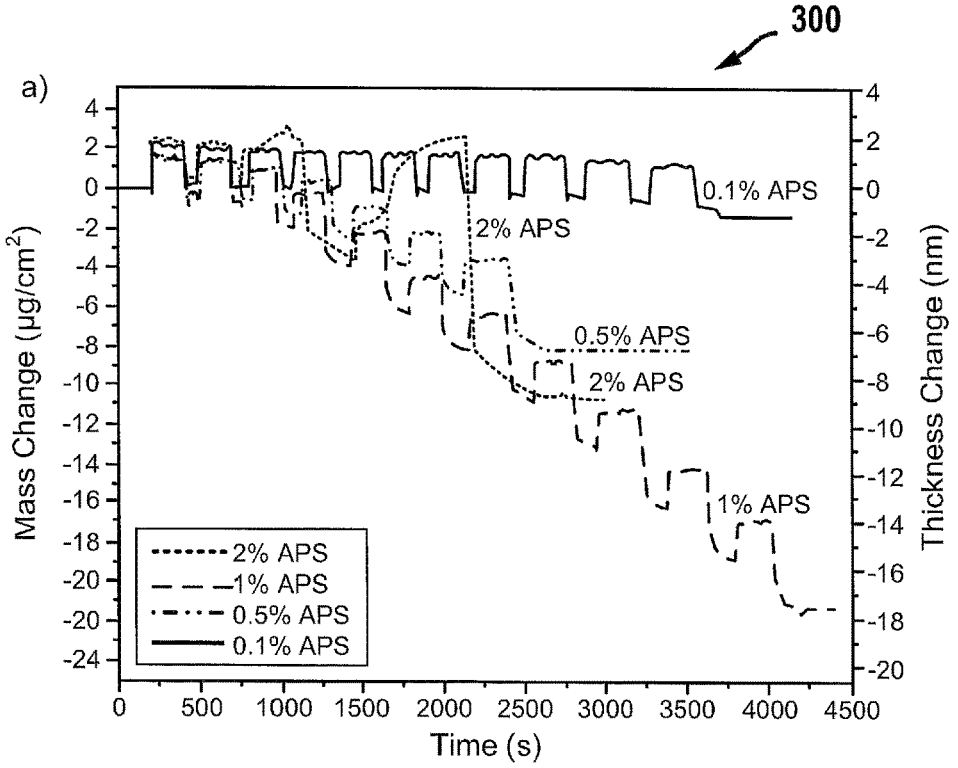
FIG. 3A is a graph of quartz crystal microbalance (QCM) data obtained from a salt-mediated wet ALE process experiment, where the data illustrates ruthenium etch behavior for a variety of oxidizer concentrations.

The graph 300 illustrated in FIG. 3A shows etch behavior at a variety of APS concentrations (e.g., 0.1% APS, 0.5% APS, 1% APS and 2% APS). The etch cycle includes 1 minute per step with oxidation in an aqueous solution containing APS, 6M HCl and 200 mM TBAC followed by a purge with 6M HCl plus 200 mM TBAC, dissolution in 1 M KCl plus 100 mM KOH, and a second purge with the 6M HCl plus 200 mM TBAC solution. As shown in the graph 300, etching is relatively slow at 0.1% APS, and ceases to be self-limiting at 2% APS, but shows reasonably self-limiting etch behavior for intermediate APS concentrations.

Figure 3B:
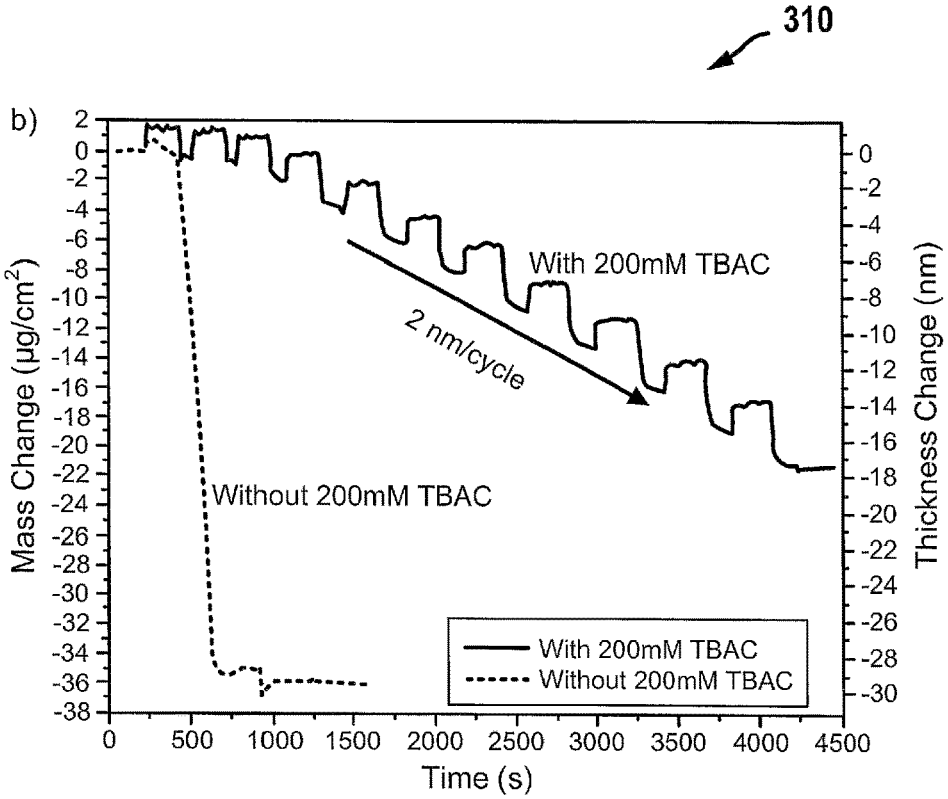
FIG. 3B is a graph of QCM data obtained from a salt-mediated wet ALE process experiment, where the data illustrates ruthenium etch behavior with and without a chloride salt.

The graph 310 illustrated in FIG. 3B shows the effect of including and removing TBAC from the etch solutions. As shown in graph 310, oxidation is not self-limiting without the tetrabutylammonium cation (TBA+). This is likely due to the higher solubility of the acid or ammonium salt of the ruthenium oxidation product compared to the tetrabutylammonium salt.

Figure 3C:
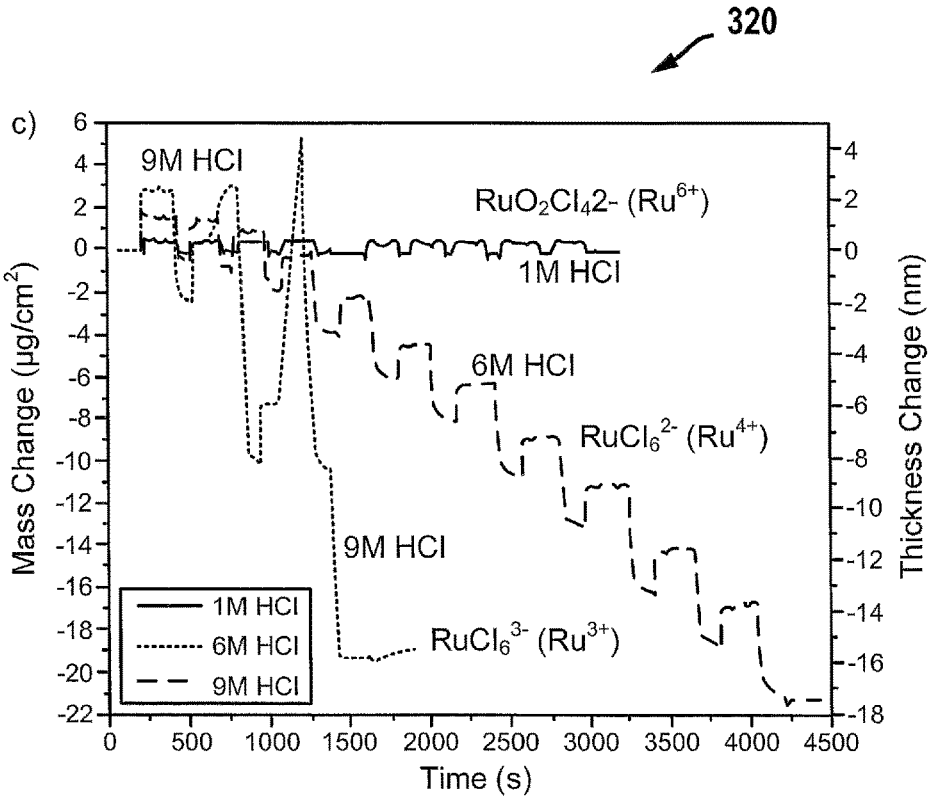
FIG. 3C is a graph of QCM data obtained from a salt-mediated wet ALE process experiment, where the data illustrates ruthenium etch behavior for a variety of HCl concentrations.

The graph 320 illustrated in FIG. 3C shows the etch behavior at a variety of HCl concentration (e.g., 1 M, 6 M and 9 M HCl). As shown in graph 320, 1 M HCl does not lead to etching, 6 M HCl leads to a well-behaved cyclic etch, and 9 M HCl leads to continuous oxidation. Literature on the chlorination chemistry of ruthenium indicates that $RuO_4$ is reduced to $RuO_2Cl_4^{2-}$ in 1 M HCl, $RuCl_6^{2-}$ in 6 M HCl, and $RuCl_6^{3-}$ in 9 M HCl. The difference in etch behavior with HCl concentration is likely due to the different solubility properties of these ruthenium polyanions.

Figure 3D:
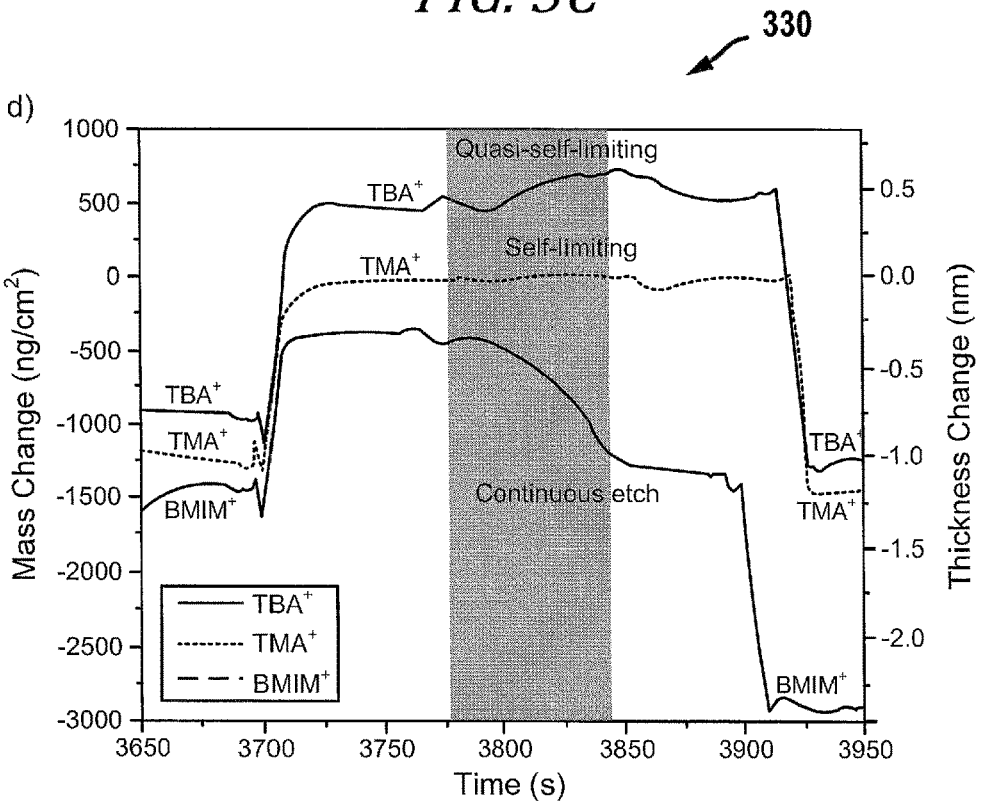
FIG. 3D is a graph of QCM data obtained from a salt-mediated wet ALE process experiment, where the data illustrates the effect of cation species on ruthenium etch behavior.

The graph 330 illustrated in FIG. 3D shows the effect of cation species on etch behavior when different cation species are used in the aqueous solution to form a ruthenium salt passivation layer. As shown in graph 330, oxidation is only quasi-self-limiting when TBA+ is used in the aqueous solution; however, the oxidation becomes completely self-limiting when tetramethylammonium (TMA+) is used. Oxidation leads to a continuous etch when 1-butyl-3-ethylimidazolium (BMIM+) is used in the aqueous solution. The differences in the solubility of the ruthenium salts formed with these three cations may explain the differences in observed etch behavior. Although TMA+ was found to be self-limiting, TMA+ is not the only possible organic cation that can be used in this process. Other cations, such as other tetraalkylammonium, phosphonium, pyridinium, pyrrolidinium, or sulfonium ions can also be used.

Figure 4:
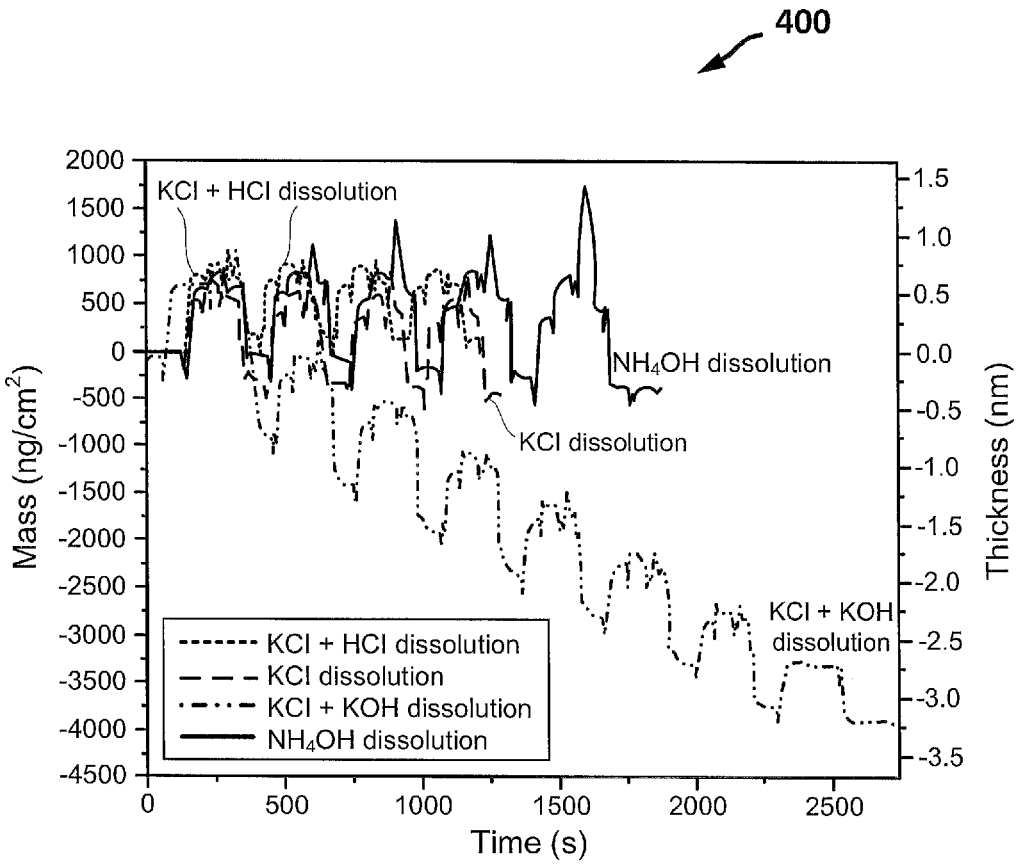
FIG. 4 is a graph of QCM data obtained from a salt-mediated wet ALE process experiment, where the data illustrates the ruthenium etch behavior using different dissolution solution compositions.

Dissolution of the ruthenium salt formed by APS oxidation in an aqueous solution (containing, for example, 6 M HCl and 200 mM TMAC) requires K+ ion exchange in a basic solution. Exploration of the etch behavior using different dissolution solution compositions (e.g., KCl and HCl dissolution, KCl dissolution, KCl and KOH dissolution and $NH_4OH$ dissolution) is shown in FIG. 4. As illustrated in the graph 400 shown in FIG. 4, a solution containing KCl and HCl contains K+ ions, but is low pH, and thus, does not etch. A KCl solution contains K+ ions, but is at neutral pH, and also does not etch. An ammonium hydroxide ($NH_4OH$) solution is at high pH, but does not contain K+ ions, and thus, does not etch. As shown in the graph 400, the only dissolution solution that resulted in etching contained both KCl and KOH. This solution contained K+ ions at high pH, indicating that both of these properties are needed to solubilize the ruthenium salts formed during the oxidation step. In addition to K+ ions, other alkali metal ions such as Li+, Na+, or Rb+ may also be used in the dissolution solution.

The etch chemistry discussed above results in an anisotropic etch due to sulfate ion adsorbing on C-plane of ruthenium crystal lattice. Sulfate strongly adsorbs on this crystal facet, but does not adsorb on ruthenium m-planes. The adsorbed sulfate ions block further etching along the C-axis. TBAPMS, sold under the trade name OXONE™, is an oxidizer that contains a high concentration of sulfate. APS is another oxidizer that forms sulfate as the reaction product. Both of these oxidizers lead to anisotropic etching of the ruthenium surface. In some embodiments, the APS or TBAPMS used in this etch chemistry can be replaced with a sulfate-free oxidizer, which should lead to isotropic etching of the ruthenium surface. However, the oxidizer utilized in the etch chemistry disclosed above must be compatible with concentrated HCl.

The data obtained for the ruthenium etch chemistry described above and shown in FIGS. 2, 3A-3D and 4 was collected using a QCM flow cell. However, the etch chemistry can be implemented using several different techniques, such as dispensing the etch solutions on a spinner or sequentially dipping the samples to be etched in the etch solutions. The only important consideration in implementing this etch chemistry is temporal separation of chemical exposures: i.e., the oxidizing solution and the dissolution solution must be kept separate and prevented from mixing on the wafer surface. Any mixing of these two solutions can lead to a continuous etch process and an increase in surface roughness.

The data obtained for the ruthenium etch chemistry described above illustrates that a ruthenium surface can be etched by exposing the ruthenium surface to an aqueous oxidizing solution, containing a persulfate salt (such as, e.g., APS, TBAPMS or OXONE™) as an oxidizer, concentrated HCl as a chloride ion source and a chloride salt (such as, e.g., TMAC, TBAC or 1-butyl-3-methylimidazolium chloride) as a cation source needed to form a ruthenium salt passivation layer on the exposed ruthenium surface. In the ruthenium experiments, the stability of the ruthenium salt passivation layer was generally dependent on the HCl concentration and the cation species (e.g., TMA+, TBA+ or BMIM+) utilized within the aqueous oxidizing solution. For example, the experiments shown that the oxidation behavior could be changed (e.g., between self-limiting, quasi-self-limiting and continuous oxidation) by adjusting the HCl concentration and cation species utilized within the oxidizing solution. The ruthenium salt passivation layer was then removed in subsequently performed dissolution step via solvent exchange in a pure solvent or K+ ion exchange in a basic dissolution solution.

Like ruthenium, other noble metals can be etched using similar etch chemistries in a wet etch or wet ALE process. For example, the wet ALE process shown in FIG. 1 may be utilized for etching other noble metals such as, but not limited to gold (Au), platinum (Pt) or iridium (Ir), by exposing the noble metal surface to an aqueous oxidizing solution containing an oxidizer, a chloride ion source (or co-oxidizer) and a cation source to form a noble metal salt passivation layer (e.g., a chloro-metalate salt, an oxychlorometalate salt or a hydrate of these salts), which can be subsequently removed via dissolution in an aqueous dissolution solution or solvent.

The oxidation behavior of the noble metal surface and the solubility of the noble metal salt passivation layer formed during the oxidation process can be controlled by adjusting the pH, the ionic strength and/or the concentration and identity of the cations used in the aqueous oxidizing solution. Adjusting these parameters can lead to forming either: (a) soluble noble metal salt species, which are soluble within the aqueous oxidizing solution and lead to a continuous oxidation process, or (b) insoluble noble metal salt species, which are insoluble within the aqueous oxidizing solution and lead to a self-limiting oxidation process. When insoluble noble metal salt species are formed, the etch amount is controlled by the extent of oxidation even though the oxidation product (e.g., the chloro-metalate salt species or the oxychlorometalate salt species) is not removed until the dissolution step. When insoluble, self-limiting noble metal salt species are formed, the noble metal salt passivation layer can be selectively dissolved in the dissolution solution, leading to a wet atomic layer etch (ALE) process.

Like ruthenium, other noble metals can be etched using an aqueous oxidizing solution containing persulfate or peroxymonosulfate ions as oxidizers. Chemicals such as ammonium persulfate (APS), tetrabutylammonium peroxymonosulfate (TBAPMS) and OXONE™ are commercial sources of these ions. While TBAPMS is the active etch component, the OXONE™ tri-salt is a commercially available source of TBAPMS. OXONE™ is the mixture of TBAPMS, tetrabutylammonium sulfate (TBAS) and tetrabutylammonium hydrogen sulfate (TBAHS). Sodium, potassium, or other cation salts of the peroxymonosulfate and persulfate ion are also commercially available and chemically active for etching noble metals. However, the ammonium or quaternary ammonium salts are generally preferred because they are metal-free and do not pose a metal contamination risk for semiconductor processing.

The aqueous oxidizing solution may also include a wide variety of chloride ion sources (or co-oxidizers) and cation sources, depending on the noble metal surface to be etched and the desired oxidation behavior. For example, the chloride ion source included within the aqueous oxidizing solution may be an acidic chloride ion source (e.g., hydrochloric acid (HCl)), in some embodiments. In other embodiments, the chloride ion source may be a non-acidic chloride ion source, such as a chloride salt. Examples of chloride salts include, but are not limited to, soluble metal chlorides, such as potassium chloride (KCl); ammonium chloride or other tetraalkylammonium chlorides, such as tetrabutylammonium chloride (TBAC) and tetramethyl ammonium chloride (TMAC); imidazolium chlorides, such as 1-butyl-3-methylimidazolium chloride; and chloride salts of phosphoniums, pyrrolidiniums, guanidiniums, triazoliums, quinoliniums, or any other organic cation. When a non-acidic chloride ion source is utilized, the non-acidic chloride ion source may provide both the chloride ion source and the cation species needed to form a noble metal salt passivation layer.

The ionic strength, co-oxidizer, pH and cation species utilized in the aqueous oxidizing solution may be individually optimized for each noble metal to be etched. When etching gold (Au), for example, APS or TBAPMS alone will not react with the exposed gold surface. Thus, the aqueous oxidizing solution must also contain a chloride ion ($Cl^-$) source as a co-oxidizer. The persulfate and peroxymonosulfate ions are highly oxidizing because the peroxide bond is easily broken to form sulfate radicals ($SO_4^{\bullet -}$). The sulfate radicals oxidize the chloride ions ($Cl^-$) to form dichloride radical ions ($Cl_2^{\bullet -}$). The dichloride radical ions ($Cl_2^{\bullet -}$) oxidize the exposed gold surface to form a noble metal salt passivation layer (e.g., a chloro-metalate salt or an oxychlorometalate salt) on the exposed gold surface.

Figure 5:
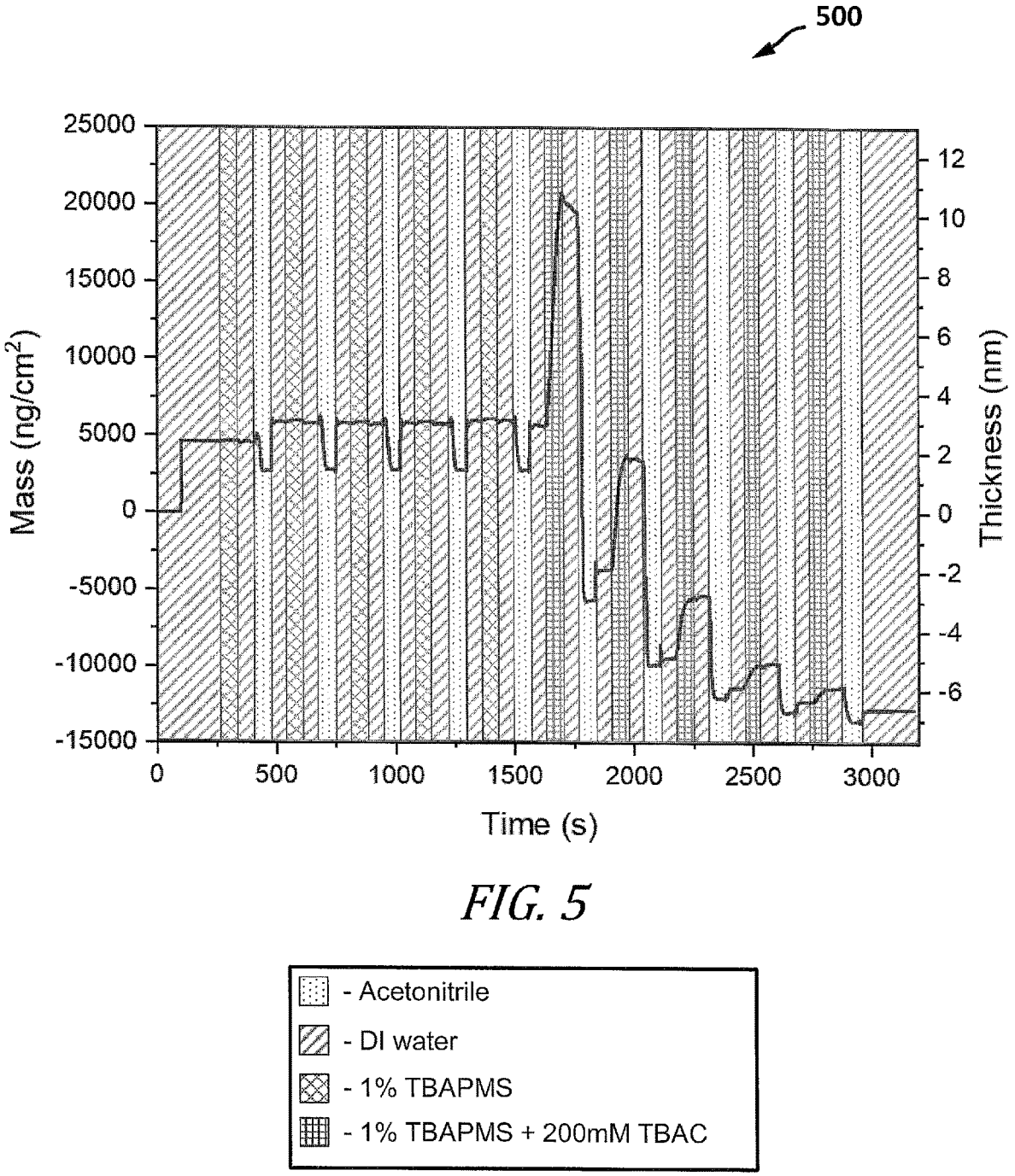
FIG. 5 is a graph of QCM data obtained from a gold (Au) surface etched in a cyclic etch experiment, where the data illustrates a continuous etch behavior.

FIG. 5 shows QCM data obtained from a gold surface etched in a cyclic etch experiment, where the gold surface is exposed to an aqueous oxidizing solution of 1% TBAPMS with and without a chloride ion ($Cl^-$) source (e.g., 200 mM TBAC). As depicted in the graph 500 shown in FIG. 5, no oxidation is observed in the absence of a chloride ion ($Cl^-$) source when the gold surface is exposed to 1% TBAPMS alone. However, when the gold surface is exposed to an aqueous solution containing both 1% TBAPMS and 200 mM TBAC as a source of chloride ions ($Cl^-$), the graph 500 shows mass gain attributed to oxidation of the gold surface. The graph 500 further shows that the oxidized gold surface (i.e., the oxidation product) is insoluble in deionized (DI) water, but soluble in acetonitrile. This opens the possibility of a cyclic etch process for gold.

As shown in FIG. 5, gold can be etched by exposing the gold surface to an aqueous oxidizing solution of TBAPMS and TBAC, followed by dissolution in acetonitrile (i.e., an organic solvent). The TBAPMS and TBAC oxidizing solution provides continuous oxidation of the gold surface, while the acetonitrile provides selective dissolution of the oxidation product. Thus, this etch process can be viewed as a two-step continuous etch, where the etch amount is controlled by the extent of oxidation even though the oxidation product is not removed until the solvent rinse step.

In addition to the chloride ion source, the pH of the aqueous oxidizing solution and the identity of the cation used therein also influence the oxidation behavior and the oxidation product. In some embodiments, an acid (such as, e.g., HCl) may be added to the aqueous oxidizing solution to decrease the pH of the aqueous oxidizing solution (e.g., to a pH level below 7.0) and provide an acidic aqueous oxidizing solution, which may be used to maintain the continuous oxidation behavior. In other embodiments, a base (such as, e.g., KOH) may be added to the aqueous oxidizing solution to raise the pH of the aqueous oxidizing solution (e.g., to a pH level above 7.0) and provide a basic aqueous oxidizing solution, which may change the oxidation behavior to a self-limiting oxidation that can be utilized in a cyclic wet ALE process.

Figure 6:
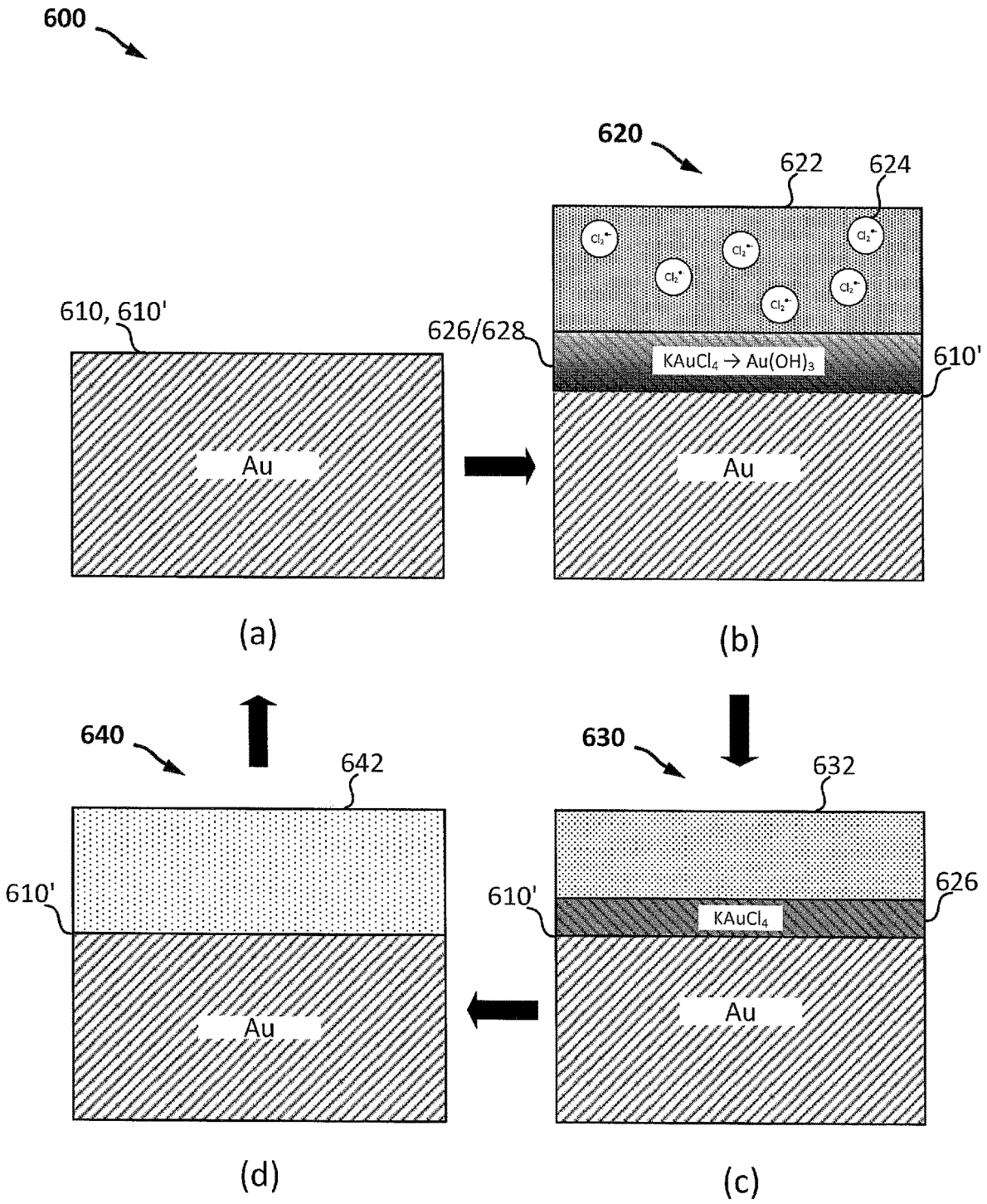
FIG. 6 is a block diagram illustrating one example of a cyclic wet ALE process that can be used to etch a gold surface in accordance with the present disclosure.

FIG. 6 illustrates one embodiment of a cyclic wet ALE process 600 that can be used to etch a gold (Au) surface in accordance with the techniques disclosed herein. In the wet ALE process 600 shown in FIG. 6, the incoming gold surface 610 shown in FIG. 6(*a*) is exposed to a basic aqueous oxidizing solution 622 in a surface modification/oxidation step 620 (shown in FIG. 6(*b*)). The basic aqueous oxidizing solution 622 may generally include a persulfate salt (as an oxidizer), a non-acidic chloride ion source (as a co-oxidizer), a cation and a base. The persulfate salt reacts with the chloride ion source to form dichloride radical ions ($Cl_2^{\bullet -}$) 624, which oxidize the exposed gold surface 610 to form a chemically modified gold surface layer 626/628 on the underlying, unmodified gold layer.

As shown in FIG. 6(*b*), the dichloride radical ions ($Cl_2^{\bullet -}$) 624 oxidize the exposed gold surface 610 to potassium tetrachloroaurate ions ($KAuCl_4^-$), thus forming a noble metal salt passivation layer 626. Although the potassium tetrachloroaurate ions ($KAuCl_4^-$) are soluble within the basic aqueous oxidizing solution 622, they are unstable under basic conditions. Under basic conditions, potassium tetrachloroaurate ions ($KAuCl_4^-$) hydrolyze to gold hydroxide ($Au(OH)_3$), which is a noble metal oxide layer 628 that is self-limiting and insoluble within the basic aqueous oxidizing solution 622. In some cases, the potassium tetrachloroaurate ions ($KAuCl_4^-$) may completely hydrolyze to gold hydroxide ($Au(OH)_3$) to form a noble metal oxide layer 628 on the underlying, unmodified gold surface 610'. In other cases, the potassium tetrachloroaurate ions ($KAuCl_4^-$) may only partially hydrolyze to gold hydroxide ($Au(OH)_3$), thus, leaving a layer of potassium tetrachloroaurate ($KAuCl_4$) (i.e., the noble metal salt passivation layer 626) under a gold hydroxide ($Au(OH)_3$) layer (i.e., the noble metal oxide layer 628), as shown in FIG. 6(*b*).

In one example embodiment, the basic aqueous oxidizing solution 622 shown in FIG. 6(*b*) may use TBAPMS as the oxidizer, potassium chloride (KCl) as the non-acidic chloride ion source and cation species, and potassium hydroxide (KOH) as the base. However, other persulfate salts, non-acidic chloride ion sources and bases can also be combined to provide a basic aqueous oxidizing solution 622 that oxidizes the exposed gold surface 610 to form a soluble noble metal salt ($KAuCl_4$) passivation layer 626, which hydrolyzes to form a self-limiting and insoluble noble metal oxide ($Au(OH)_3$) layer 628.

Although the noble metal oxide ($Au(OH)_3$) layer 628 is insoluble in the basic aqueous oxidizing solution 622, it is readily soluble in an acidic dissolution solution, such as for example, an HCl solution. As shown in FIG. 6(*c*), for example, the noble metal oxide ($Au(OH)_3$) layer 628 may be selectively dissolved in a subsequently performed dissolution step 630 by exposing the noble metal oxide ($Au(OH)_3$) layer 628 to an HCl dissolution solution 632. The HCl dissolution solution 632 selectively dissolves the noble metal oxide ($Au(OH)_3$) layer 628 to remove the noble metal oxide ($Au(OH)_3$) layer 628. The HCl dissolution solution 632 may also re-chlorinate any remaining $Au(OH)_3$ to soluble potassium tetrachloroaurate ions ($KAuCl_4^-$).

As shown in FIG. 6(*d*), any $KAuCl_4$ remaining on the unmodified gold surface 610' can be dissolved in a subsequent rinse step 640 by exposing the potassium tetrachloroaurate ($KAuCl_4$) layer (i.e., the noble metal salt passivation layer 626) to an aqueous solution 642. In some embodiments, the noble metal salt passivation layer 626 can be dissolved in an aqueous solution 642 comprising deionized water. Once the chemically modified gold surface layer 626/628 is removed to expose the unmodified gold surface 610' (as shown in FIG. 6(*a*)), the surface modification step 620 shown in FIG. 6(*b*), the dissolution step 630 shown in FIG. 6(*c*) and the rinse step 640 shown in FIG. 6(*d*) can be repeated for one or more ALE cycles to selectively etch or remove a predetermined amount of gold.

FIG. 7A shows QCM data obtained from a gold surface etched in a cyclic wet ALE process, which uses an aqueous solution of 1% TBAPMS, 200 mM potassium chloride (KCl) and 100 mM potassium hydroxide (KOH) as the basic aqueous oxidizing solution 622 and 2 M HCl as the HCl dissolution solution 632, followed by a deionized (DI) water rinse. As depicted in the graph 700 shown in FIG. 7A, the ratio mass gain on oxidation to mass loss after dissolution is consistent with the gold surface being oxidized to gold hydroxide ($Au(OH)_3$) under these conditions. The graph 700 further shows that the oxidation of the gold surface is self-limiting in a basic aqueous oxidizing solution comprising 1% TBAPMS, KCl, and KOH.

New etch chemistries are described above for etching ruthenium and gold in a continuous etch process or a self-limiting, wet ALE process. As noted above, ruthenium surfaces can be oxidized by exposing the ruthenium surfaces to an aqueous oxidizing solution, which uses a persulfate salt (such as, e.g., APS, TBAPMS or OXONE™) as an oxidizer, an acidic chloride ion source (e.g., HCl) as a co-oxidizer and a chloride salt (such as, e.g., TMAC, TBAC or 1-butyl-3-methylimidazolium chloride) as a cation source needed to form a noble metal salt (e.g., a ruthenate salt or a perruthenate salt) passivation layer on the exposed ruthenium surface. The noble metal salt passivation layer can be removed in a subsequently performed dissolution step via solvent exchange in a pure solvent or K+ ion exchange in a basic dissolution solution.

Likewise, gold surfaces can be oxidized by exposing the gold surfaces to an aqueous oxidizing solution, which uses a persulfate salt (such as, e.g., APS, TBAPMS or OXONE™) as an oxidizer and a non-acidic chloride ion source (e.g., a chloride salt, such as KCl, TMAC, TBAC or 1-butyl-3-methylimidazolium chloride) as the co-oxidizer and cation source needed to form a noble metal salt passivation layer on the exposed gold surface. Gold surfaces can also be oxidized by exposing the gold surfaces to an aqueous oxidizing solution, which uses a persulfate salt (such as, e.g., APS, TBAPMS or OXONE™) as an oxidizer and an acidic chloride ion source (e.g., HCl) as the co-oxidizer and cation source. The noble metal salt passivation layer can be removed via dissolution in a solvent (e.g., acetonitrile) or an acidic dissolution solution (e.g., HCl) followed by a deionized water rinse.

The oxidation behavior of the ruthenium or gold surface, and the solubility of the noble metal salt passivation layer formed during the oxidation process, can be controlled by adjusting the pH, the ionic strength and/or the concentration and identity of the cations used in the aqueous oxidizing solution to provide a continuous or self-limiting oxidation process. For example, the HCl concentration and/or cation species used in the aqueous oxidizing solution can be adjusted to provide a continuous or self-limiting oxidation process. In some cases, a base (such as, e.g., KOH) may be added to the aqueous oxidizing solution to change the pH of the oxidizing solution and provide a self-limiting oxidation process.

Since the oxidation behavior of platinum (Pt) is similar to that of ruthenium and gold, similar etch chemistries can also be used to etch platinum in a continuous etch process or a self-limiting, wet ALE process. Experiments were conducted and QCM data was obtained for etching a platinum surface in a cyclic wet etch process, which uses an aqueous oxidizing solution to oxidize the platinum surface and form a noble metal salt passivation layer on the exposed platinum surface, and an aqueous dissolution solution to dissolve the noble metal salt passivation layer. Various experiments were conducted to determine etch chemistries providing continuous and self-limiting oxidation behaviors.

In one experiment, the platinum surface was exposed to a basic aqueous oxidizing solution containing %1 TBAPMS, 200 mM KCl and 100 mM KOH, followed by dissolution in deionized (DI) water. The QCM data for a platinum surface exposed to a basic aqueous oxidizing solution of TBAPMS, KCl, and KOH showed a drop in resonant frequency of the crystal, which indicates a self-limiting mass gain on exposure to the oxidizing solution. The QCM data further showed a net mass loss after rinsing with DI water. This mass loss indicates that a cyclic wet ALE process for platinum using a basic aqueous oxidizing solution of TBAPMS, KCl, and KOH to oxidize and DI water to dissolve is possible. In the experiment, the etch chemistry used to etch the platinum surface resulted in the removal of approximately 0.2 nm (or about 0.1 monolayers) of platinum per cycle.

In another experiment, a platinum surface was exposed to an acidic aqueous oxidizing solution containing %1 TBAPMS, 200 mM TBAC and 100 mM HCl, followed by dissolution in deionized (DI) water. The QCM data for a platinum surface exposed to an acidic aqueous solution of TBAPMS, TBAC, and HCl showed that oxidation ceases to be self-limiting if the pH of the aqueous oxidizing solution is lowered with the addition of HCl. The QCM data further showed an initial mass gain on exposure to the oxidizing solution, followed by a continuous mass loss. Rinsing with DI water afterwards showed a net metal loss equivalent to between 0.26 nm of platinum. There was additional mass lost during the DI water rinse, indicating that the continuous platinum etch is dissolution limited. Overall, the etch rate of the continuous platinum etch process was observed to be about 0.05 nm/min.

Figure 7B:
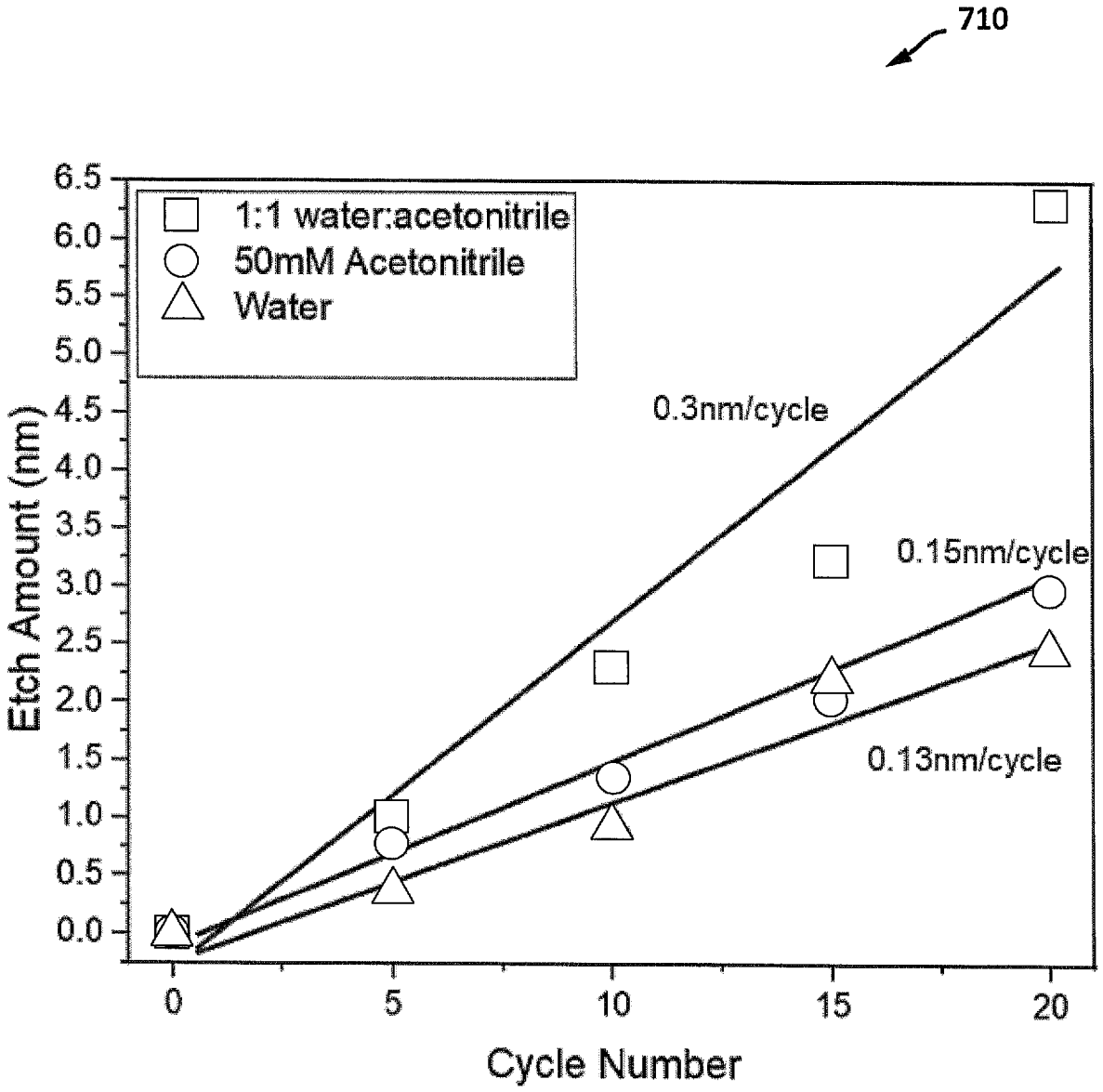
FIG. 7B is a graph illustrating the total etch amount (nm) as a function of cycle number achieved when a platinum surface is exposed to various aqueous oxidizing solutions for 1 minute at 80° C. followed by a deionized (DI) water rinse.
Figure 7C:
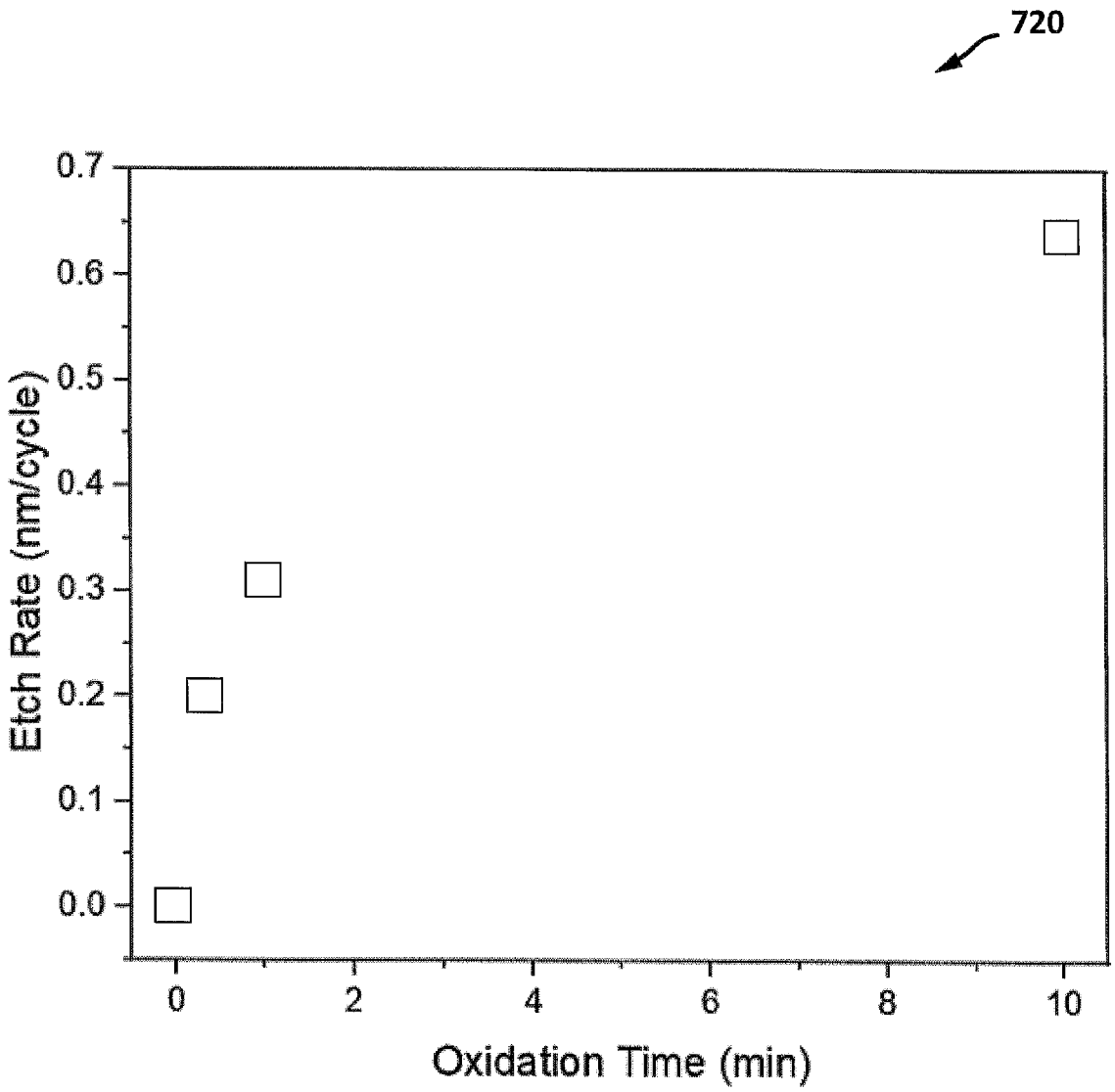
FIG. 7C is a graph illustrating the total etch amount (nm) as a function of oxidation time (minutes) achieved when a platinum surface is exposed to a particular aqueous oxidizing solution for 1 minute at 80° C. followed by a deionized (DI) water rinse.

In yet another experiment, a platinum surface was exposed to various aqueous oxidizing solutions at an elevated temperature, followed by dissolution in deionized (DI) water. The graph 710 shown in FIG. 7B illustrates the total etch amount (nm) as a function of cycle number achieved when the platinum surface is exposed to: (a) a first aqueous oxidizing solution containing %1 APS, 100 mM KCl and 1 M HCl in 1:1 water:acetonitrile, (b) a second aqueous oxidizing solution containing 50 mM acetonitrile in water, and (c) a third aqueous oxidizing solution containing water only, for 1 minute at 80° C. followed by a deionized (DI) water rinse. As shown in FIG. 7B, the etch rate per cycle increases with acetonitrile concentration (e.g., 0.13 nm/cycle for (c), 0.15 nm/cycle for (b) and 0.3 nm/cycle for (a)). The etch rate also increases with oxidation temperature, compared to experiments conducted at room temperature. The graph 720 shown in FIG. 7C illustrates the total etch amount (nm) as a function of oxidation time (minutes) achieved when the platinum surface is exposed to the first aqueous oxidizing solution for 1 minute at 80° C. followed by a deionized (DI) water rinse. As shown in FIG. 7C the etch rate per cycle follows power-law kinetics. This less than linear behavior indicates quasi-self-limiting oxidation and could indicate multi-step oxidation.

In some embodiments, self-limiting oxidation behavior may be restored by removing TBAC from the oxidizing solution. In another experiment, for example, a platinum surface was exposed to another acidic aqueous oxidizing solution containing %1 TBAPMS and 100 mM HCl.

Removing TBAC leaves only TBAPMS and HCl in the acidic aqueous oxidizing solution. This changes the ratio of $TBA^+$ and $H^+$ cations in the oxidizing solution by eliminating the $TBA^+$ cations. This change in cation distribution makes the oxidation process self-limiting. The self-limiting oxidation layer can then be removed with a DI water rinse. In some cases, rinsing with DI water may result in the removal of approximately 0.06 nm of platinum per cycle.

In each of the experiments mentioned above, an aqueous oxidizing solution containing a persulfate salt, a chloride ion source and a cation is used to oxidize the platinum surface and form a noble metal salt passivation layer. Similar to the gold oxidation process described above, the persulfate salt (e.g., TBAPMS or APS) used in the aqueous oxidizing solution reacts with the chloride ion source (e.g., KCl, TBAC and/or HCl) to form dichloride radical ions ($Cl_2^{\bullet-}$), which oxidize the exposed platinum surface to tetrachloroplatinate ($PtCl_4^{2-}$) or hexachloroplatinate ($PtCl_6^{2-}$) ions, thus forming a noble metal salt passivation layer, which is removed with a DI water rinse. In some embodiments, an acetonitrile-water mixed solvent system and low pH may be used to promote hexachloroplatinate ($PtCl_6^{2-}$) ion formation. In some embodiments, a mixed cation system containing, e.g., $NH_4^+$ and $K^+$ cations may also be used to improve solubility of the noble metal salt passivation layer.

Iridium (Ir) is a noble metal that shares similar oxidation chemistry to platinum, although it is slightly more corrosion resistant in acidic solutions. The hexachloroiridate ($IrCl_6^{2-}$) ion, which is the iridium analog of the hexachloroplatinate ($PtCl_6^{2-}$) ion important in the platinum etch chemistry, is also an important species in the iridium oxidation solution chemistry. As such, an aqueous oxidizing solution that uses a persulfate salt (e.g., TBAPMS or APS) and as oxidizer and an acidic chloride ion source or a non-acidic chloride ion source as a co-oxidizer may also be used to successfully etch iridium.

The noble metal wet ALE process described herein may be performed within a variety of semiconductor processing systems. While the ruthenium wet ALE process described herein can be accomplished using many different process chambers, tools and apparatuses, the processing equipment used to perform the ruthenium wet ALE process is preferably capable of running at (or near) room temperature and at (or near) atmospheric pressure. In one example implementation, the ruthenium wet ALE process described herein may be performed within a spin chamber. When a spin chamber is utilized, etch solutions are dispensed from a nozzle positioned over the substrate and are distributed by the rotational motion of a spin chuck on which the substrate is disposed.

Figure 8:
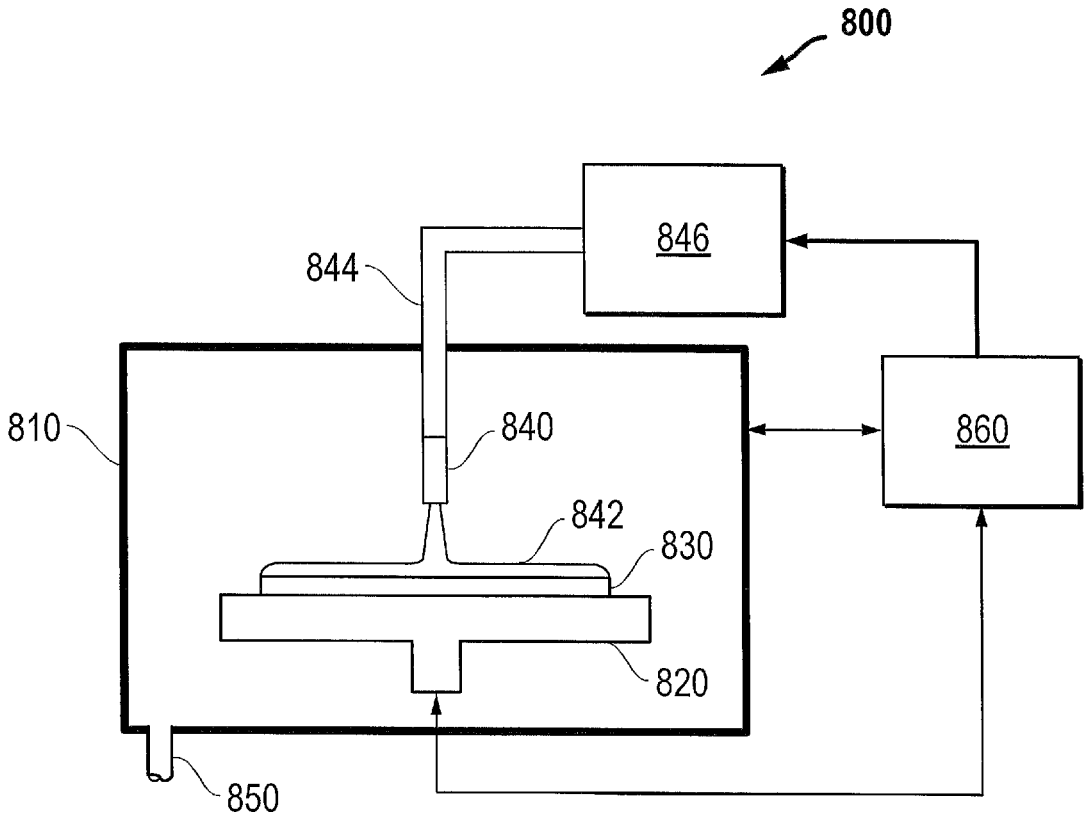
FIG. 8 is a block diagram of an example processing system that can use the techniques described herein to etch a noble metal surface in accordance with the present disclosure.

FIG. 8 illustrates one embodiment of a processing system 800 that may use the techniques described herein to etch a noble metal, such as ruthenium (Ru), gold (Au), platinum (Pt) or iridium (Ir), on a surface of a substrate 830. As shown in FIG. 8, the processing system 800 includes a process chamber 810, which in some embodiments, may be a pressure controlled chamber. In the embodiment shown in FIG. 8, the process chamber 810 is a spin chamber having a spinner 820 (or spin chuck), which is configured to spin or rotate at a rotational speed. A substrate 830 is held on the spinner 820, for example, via electrostatic force or vacuum pressure. In one example, the substrate 830 may be a semiconductor wafer having a polycrystalline material, such as ruthenium, formed on or within the substrate 830.

The processing system 800 shown in FIG. 8 further includes a liquid nozzle 840, which is positioned over the substrate 830 for dispensing various etch solutions 842 onto a surface of the substrate 830. The etch solutions 842 dispensed onto the surface of the substrate 830 may generally include a surface modification solution to chemically modify the noble metal surface and form a modified surface layer (e.g., a chloro-metalate salt passivation layer or an oxychlorometalate salt passivation layer), and a dissolution solution to selectively remove the modified surface layer from the noble metal surface. Purge solutions may also be dispensed onto the surface of the substrate 830 between surface modification and dissolution steps to separate the surface modification and dissolution solutions. Examples of surface modification, dissolution and purge solutions are discussed above.

As shown in FIG. 8, the etch solutions 842 may be stored within a chemical supply system 846, which may include one or more reservoirs for holding the various etch solutions 842 and a chemical injection manifold, which is fluidly coupled to the process chamber 810 via a liquid supply line 844. In operation, the chemical supply system 846 may selectively apply desired chemicals to the process chamber 810 via the liquid supply line 844 and the liquid nozzle 840 positioned within the process chamber 810. Thus, the chemical supply system 846 can be used to dispense the etch solutions 842 onto the surface of the substrate 830. The process chamber 810 may further include a drain 850 for removing the etch solutions 842 from the process chamber 810.

Components of the processing system 800 can be coupled to, and controlled by, a controller 860, which in turn, can be coupled to a corresponding memory storage unit and user interface (not shown). Various processing operations can be executed via the user interface, and various processing recipes and operations can be stored in the memory storage unit. Accordingly, a given substrate 830 can be processed within the process chamber 810 in accordance with a particular recipe. In some embodiments, a given substrate 830 can be processed within the process chamber 810 in accordance with an etch recipe that utilizes the wet ALE techniques described herein for etching noble metals.

The controller 860 shown in block diagram form in FIG. 8 can be implemented in a wide variety of manners. In one example, the controller 860 may be a computer. In another example, the controller 860 may include one or more programmable integrated circuits that are programmed to provide the functionality described herein. For example, one or more processors (e.g., microprocessor, microcontroller, central processing unit, etc.), programmable logic devices (e.g., complex programmable logic device (CPLD), field programmable gate array (FPGA), etc.), and/or other programmable integrated circuits can be programmed with software or other programming instructions to implement the functionality of a prescribed plasma process recipe. It is further noted that the software or other programming instructions can be stored in one or more non-transitory computer-readable mediums (e.g., memory storage devices, flash memory, dynamic random access memory (DRAM), reprogrammable storage devices, hard drives, floppy disks, DVDs, CD-ROMs, etc.), and the software or other programming instructions when executed by the programmable integrated circuits cause the programmable integrated circuits to perform the processes, functions, and/or capabilities described herein. Other variations could also be implemented.

As shown in FIG. 8, the controller 860 may be coupled to various components of the processing system 800 to receive inputs from, and provide outputs to, the components. For example, the controller 860 may be coupled to: the process chamber 810 for controlling the temperature and/or pressure within the process chamber 810; the spinner 820 for controlling the rotational speed of the spinner 820; and the chemical supply system 846 for controlling the various etch solutions 842 dispensed onto the substrate 830. The controller 860 may control other processing system components not shown in FIG. 8, as is known in the art.

In some embodiments, the controller 860 may control the various components of the processing system 800 in accordance with an etch recipe that utilizes the wet ALE techniques described herein for etching noble metals. For example, the controller 860 may supply various control signals to the chemical supply system 846, which cause the chemical supply system 846 to: a) dispense a surface modification solution onto the surface of the substrate 830 to chemically modify exposed surfaces of the noble metal and create a modified surface layer (e.g., a chloro-metalate salt passivation layer or an oxychlorometalate salt passivation layer) on the substrate 830; b) rinse the substrate 830 with a first purge solution to remove excess reactants from the surface; c) dispense a dissolution solution onto the surface of the substrate 830 to selectively remove or dissolve the modified surface layer; and d) rinse the substrate with a second purge solution to remove the dissolution solution from the surface of the substrate 830. In some embodiments, the controller 860 may supply the control signals to the chemical supply system 846 in a cyclic manner, such that the steps a)-d) are repeated for one or more ALE cycles, until a desired amount of the noble metal has been removed.

The controller 860 may also supply control signals to other processing system components. In some embodiments, for example, the controller 860 may supply control signals to the spinner 820 and/or the chemical supply system 846 to dry the substrate 830 after the second purge step is performed. In one example, the controller 860 may control the rotational speed of the spinner 820, so as to dry the substrate 830 in a spin dry step. In another example, control signals supplied from the controller 860 to the chemical supply system 846 may cause a drying agent (such as, e.g., isopropyl alcohol) to be dispensed onto the surface of the substrate 830 to further assist in drying the substrate before performing the spin dry step.

In some embodiments, the controller 860 may control the temperature and/or the pressure within the process chamber 810. In some embodiments, the surface modification, dissolution and purge steps of the ruthenium wet ALE process described herein may be performed at roughly the same temperature and pressure. In one example implementation, the surface modification, dissolution and purge steps may each be performed at (or near) atmospheric pressure and room temperature. In another example implementation, the surface modification step may be performed at an elevated temperature. Performing the processing steps within the same process chamber at roughly the same temperature and pressure decreases the cycle time and improves the throughput of the wet ALE process described herein by avoiding unnecessary chamber transitions and temperature/pressure changes.

It is noted, however, that the embodiments described herein are not strictly limited to only atmospheric pressure and room temperature, nor are they limited to a particular process chamber. In other embodiments, one or more of the surface modification, dissolution and purge steps can be run at above atmospheric pressure in a pressure vessel, or at reduced pressure in a vacuum chamber. Etch solutions can be dispensed in these environments as long as the vapor pressure of the liquid is lower than the chamber pressure. For these implementations, a spinner with a liquid dispensing nozzle would be placed in the pressure vessel or vacuum chamber. The temperature of the liquid being dispensed can be elevated to any temperature below its boiling point at the pressure of the process. In one example implementation, the dissolution step may be performed at 100° C. as shown in FIGS. 3A and 3B. As noted above, higher liquid temperatures can increase the kinetics of dissolution.

Figure 9:
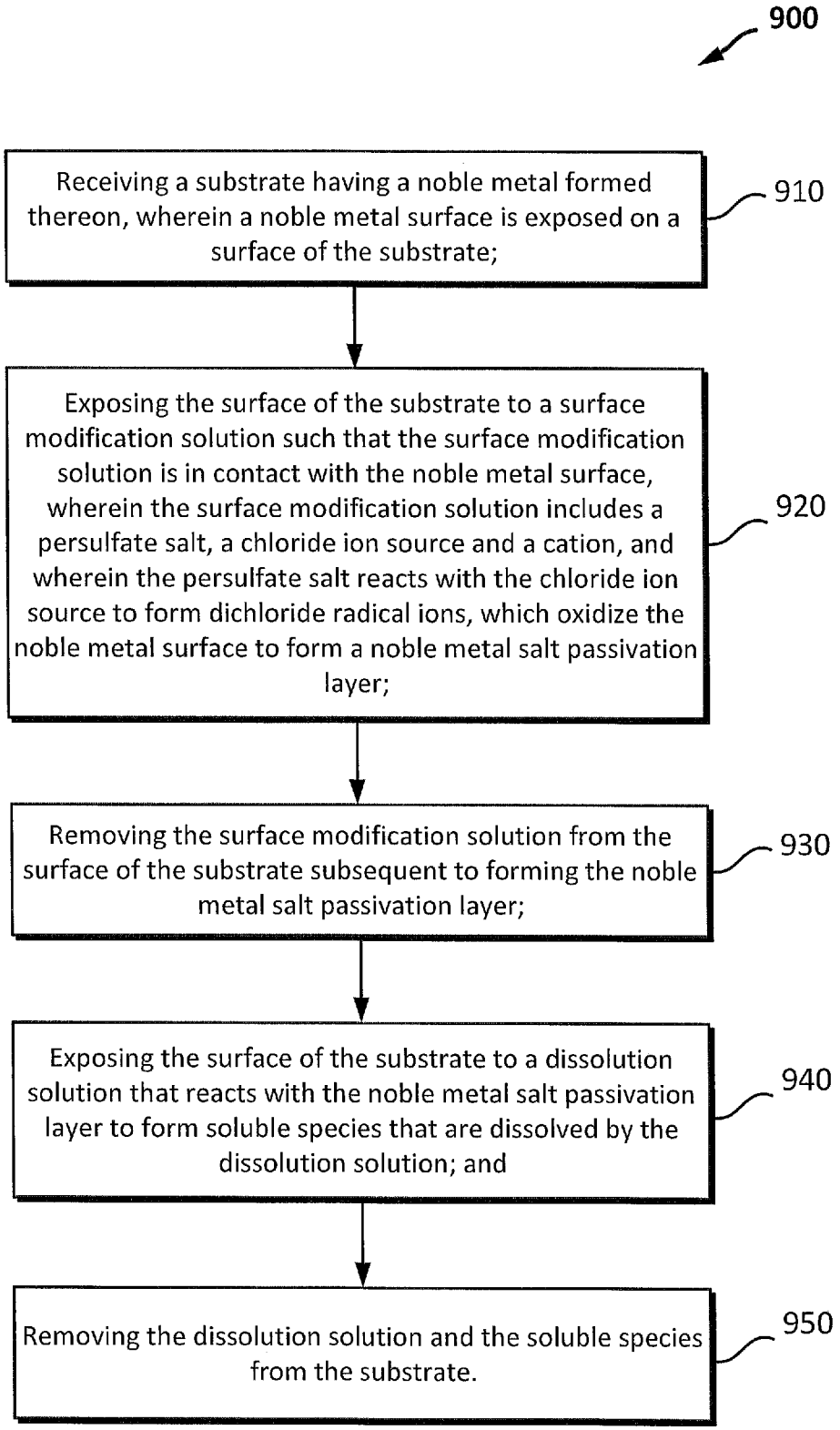
FIG. 9 is a flowchart diagram illustrating one embodiment of a method utilizing the techniques described herein.
Figure 10:
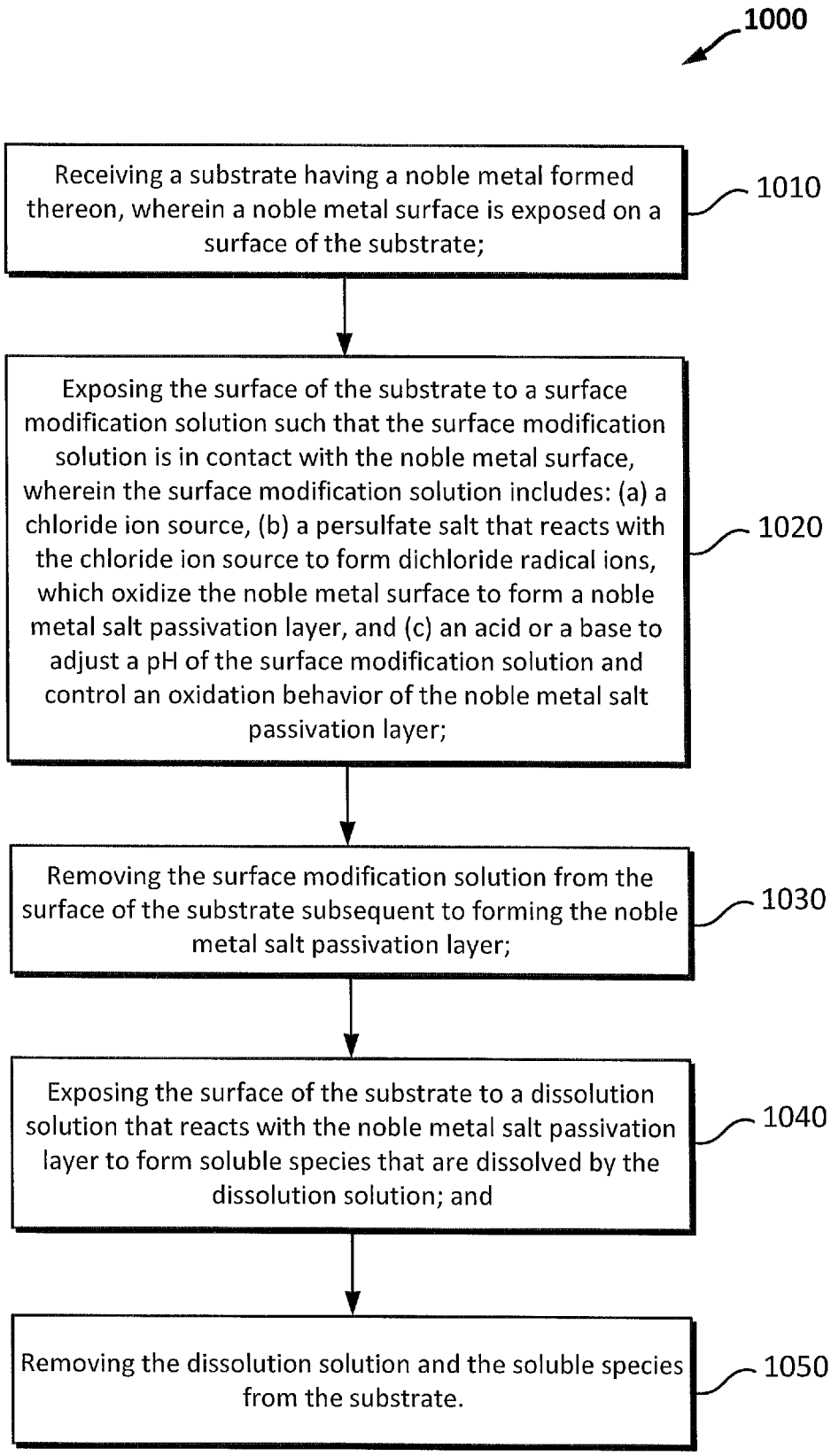
FIG. 10 is a flowchart diagram illustrating another embodiment of a method utilizing the techniques described herein.
Figure 11:
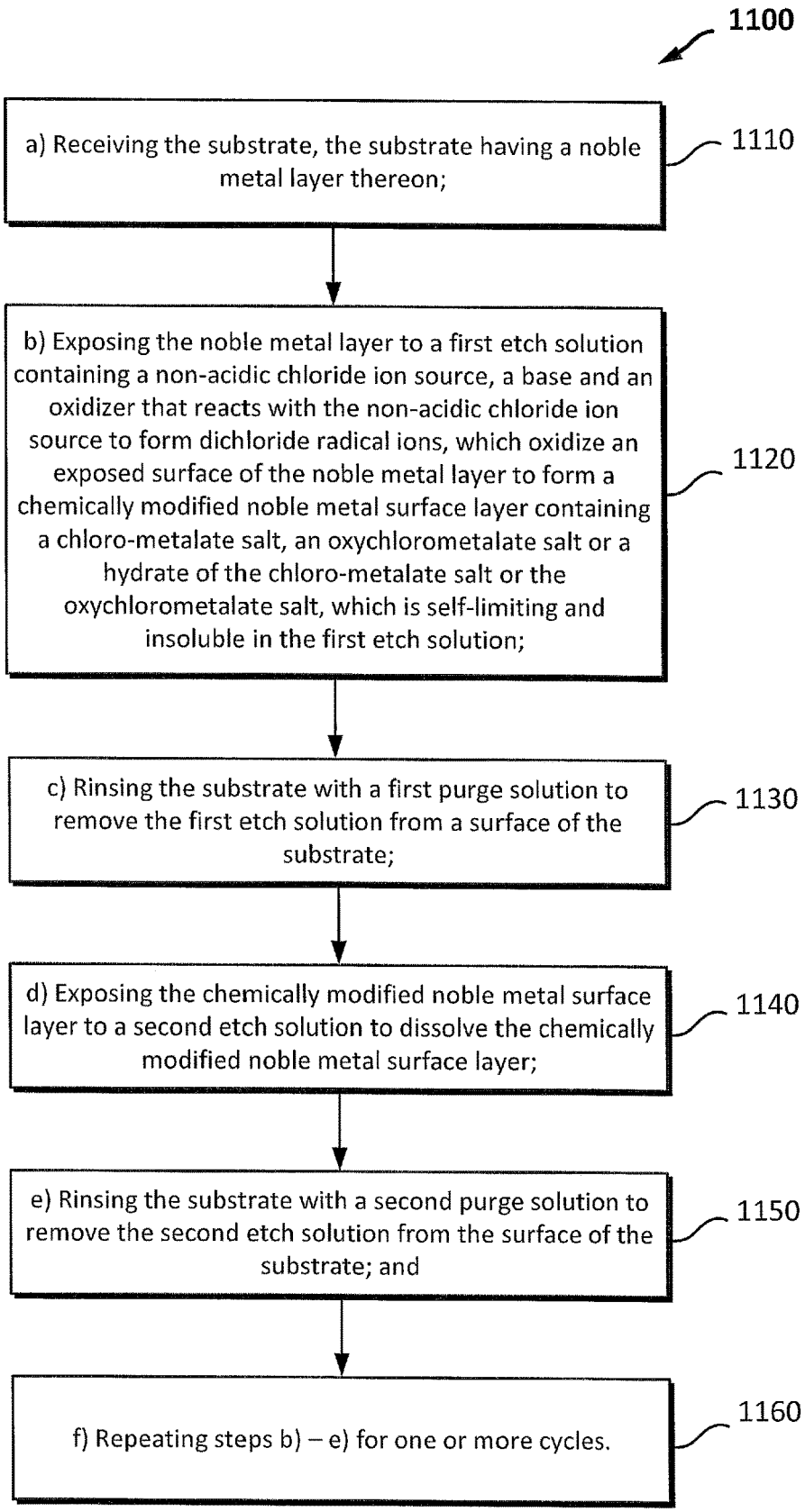
FIG. 11 is a flowchart diagram illustrating yet another embodiment of a method utilizing the techniques described herein.

FIGS. 9-11 illustrate exemplary methods that utilize the wet etch chemistries described herein for etching noble metals in a wet ALE process. It will be recognized that the embodiments of FIGS. 9-11 are merely exemplary and additional methods may utilize the techniques described herein. Further, additional processing steps may be added to the methods shown in the FIGS. 9-11 as the steps described are not intended to be exclusive. Moreover, the order of the steps is not limited to the order shown in the figures as different orders may occur and/or various steps may be performed in combination or at the same time.

FIG. 9 illustrates one embodiment of a method 900 of etching. The method 900 shown in FIG. 9 may generally include receiving a substrate having a noble metal formed thereon, wherein a noble metal surface is exposed on a surface of the substrate (in step 910), and exposing the surface of the substrate to a surface modification solution such that the surface modification solution is in contact with the noble metal surface (in step 920). In the method 900 shown in FIG. 9, the surface modification solution may generally include a persulfate salt, a chloride ion source and a cation. The persulfate salt reacts with the chloride ion source to form dichloride radical ions, which oxidize the noble metal surface to form a noble metal salt passivation layer. Next, the method 900 may include removing the surface modification solution from the surface of the substrate subsequent to forming the noble metal salt passivation layer (in step 930) and exposing the surface of the substrate to a dissolution solution that reacts with the noble metal salt passivation layer to form soluble species that are dissolved by the dissolution solution (in step 940). Next, the method 900 may include removing the dissolution solution and the soluble species from the substrate (in step 950).

The method 900 shown in FIG. 9 may generally be used to etch a variety of noble metals including, but not limited to, ruthenium (Ru), gold (Au), platinum (Pt) or iridium (Ir). A variety of different etch chemistries may be used in the surface modification solution and the dissolution solution, depending on the noble metal being etched.

As noted above, for example, the surface modification solution may generally include a persulfate salt, a chloride ion source and a cation. In some embodiments, the persulfate salt may be an ammonium or quaternary ammonium cation salt of the persulfate or peroxymonosulfate ion (such as, e.g., APS, TBAPMS or OXONE™). In some embodiments, the chloride ion source may be an acidic chloride ion source, such as hydrochloric acid (HCl). In other embodiments, the chloride ion source may be a non-acidic chloride ion source selected from a group comprising of soluble metal chlorides, ammonium chloride and other tetraalkylammonium chlorides, imidazolium chlorides, and chloride salts of phosphoniums, pyrrolidiniums, guanidiniums, triazoliums, quinoliniums and other organic cations. In example embodiments, the non-acidic chloride ion source may be potassium chloride (KCl), tetrabutylammonium chloride (TBAC), tetramethyl ammonium chloride (TMAC) and/or 1-butyl-3-methylimidazolium chloride.

The dissolution solution may include an aqueous dissolution solution or a solvent. In some embodiments, the dissolution solution may be an aqueous dissolution solution containing an acid selected from a group comprising of hydrochloric acid (HCl), nitric acid and sulfuric acid. In other embodiments, the dissolution solution may be a solvent selected from a group comprising of deionized water, acetonitrile, alcohols, acetates, ethers and ketones.

In one example embodiment, the surface modification solution may include: (a) ammonium persulfate (APS) or tetrabutylammonium peroxymonosulfate (TBAPMS) as the persulfate salt, and (b) tetrabutylammonium chloride (TBAC) as the chloride ion source. In such an embodiment, exposing the surface of the substrate to the surface modification solution (in step 920) may oxidize the noble metal surface and form the noble metal salt passivation layer in a continuous oxidation process.

In another example embodiment, the surface modification solution may include: (a) ammonium persulfate (APS) or tetrabutylammonium peroxymonosulfate (TBAPMS) as the persulfate salt, (b) potassium chloride (KCl) as the chloride ion source, and (c) a base. In such an embodiment, exposing the surface of the substrate to the surface modification solution (in step 920) may oxidize the noble metal surface and form the noble metal salt passivation layer in a self-limiting oxidation process.

In yet another example embodiment, the surface modification solution may include: (a) ammonium persulfate (APS) or tetrabutylammonium peroxymonosulfate (TBAPMS) as the persulfate salt, and (b) hydrochloric acid (HCl) as the chloride ion source. In such an embodiment, exposing the surface of the substrate to the surface modification solution (in step 920) may oxidize the noble metal surface and form the noble metal salt passivation layer in a self-limiting oxidation process.

FIG. 10 illustrates another embodiment of a method 1000 of etching. The method 1000 shown in FIG. 10 may generally include receiving a substrate having a noble metal formed thereon, wherein a noble metal surface is exposed on a surface of the substrate (in step 1010), and exposing the surface of the substrate to a surface modification solution such that the surface modification solution is in contact with the noble metal surface (in step 1020). In the method 1000 shown in FIG. 10, the surface modification solution may generally include: (a) a chloride ion source, (b) a persulfate salt that reacts with the chloride ion source to form dichloride radical ions, which oxidize the noble metal surface to form a noble metal salt passivation layer, and (c) an acid or a base to adjust a pH of the surface modification solution and control an oxidation behavior of the noble metal salt passivation layer. Next, the method 1000 may include removing the surface modification solution from the surface of the substrate subsequent to forming the noble metal salt passivation layer (in step 1030) and exposing the surface of the substrate to a dissolution solution that reacts with the noble metal salt passivation layer to form soluble species that are dissolved by the dissolution solution (in step 1040). Next, the method 1000 may include removing the dissolution solution and the soluble species from the substrate (in step 1050).

The method 1000 shown in FIG. 10 may generally be used to etch a variety of noble metals including, but not limited to, ruthenium (Ru), gold (Au), platinum (Pt) or iridium (Ir). A variety of different etch chemistries may be used in the surface modification solution, depending on the noble metal being etched and the desired oxidation behavior. For example, the surface modification solution may generally include an ammonium or quaternary ammonium cation salt of the persulfate or peroxymonosulfate ion (such as, e.g., APS, TBAPMS or OXONE™) as the persulfate salt. The surface modification solution may further include a non-acidic chloride ion source or an acidic chloride ion source and the acid or the base to control the oxidation behavior of the noble metal salt passivation layer.

In some embodiments, for example, the surface modification solution may further include a non-acidic chloride ion source and the acid. In such embodiments, the acid may decrease the pH of the surface modification solution to oxidize the noble metal surface and form the noble metal salt passivation layer in a continuous oxidation process. In one example implementation, the surface modification solution may include tetrabutylammonium chloride (TBAC) as the non-acidic chloride ion source, tetrabutylammonium peroxymonosulfate (TBAPMS) as the persulfate salt, and hydrochloric acid (HCl) as the acid.

In other embodiments, the surface modification solution may further include a non-acidic chloride ion source and the base. In such embodiments, the base may increase the pH of the of the surface modification solution to oxidize the noble metal surface and form the noble metal passivation layer in a self-limiting oxidation process. In one example implementation, the surface modification solution may include potassium chloride (KCl) as the non-acidic chloride ion source, tetrabutylammonium peroxymonosulfate (TBAPMS) as the persulfate salt, and potassium hydroxide (KOH) as the base.

In yet other embodiments, the surface modification solution may further include an acidic chloride ion source as the chloride ion source and the acid. In such embodiments, the acidic chloride ion source may change a ratio of cations in the surface modification solution to oxidize the noble metal surface and form the noble metal salt passivation layer in a self-limiting oxidation process. In one example implementation, the surface modification solution may include tetrabutylammonium peroxymonosulfate (TBAPMS) as the persulfate salt and hydrochloric acid (HCl) as the acidic chloride ion source.

FIG. 11 illustrates one embodiment of a method 1100 that may be used for etching a substrate using a wet atomic layer etching (ALE) process. The method 1100 shown in FIG. 11 may generally include: a) receiving the substrate, the substrate having a noble metal layer thereon (in step 1110); b) exposing the noble metal layer to a first etch solution containing a non-acidic chloride ion source, a base and an oxidizer that reacts with the non-acidic chloride ion source to form dichloride radical ions, which oxidize the noble metal surface to form a chemically modified noble metal surface layer containing a chloro-metalate salt, an oxychlorometalate salt or a hydrate of the chloro-metalate salt or the oxychlorometalate salt, which is self-limiting and insoluble in the first etch solution (in step 1120); c) rinsing the substrate with a first purge solution to remove the first etch solution from a surface of the substrate (in step 1130); d) exposing the chemically modified noble metal surface layer to a second etch solution to dissolve the chemically modified noble metal surface layer (in step 1140); e) rinsing the substrate with a second purge solution to remove the second etch solution from the surface of the substrate (in step 1150); and f) repeating steps b)-e) for one or more cycles (in step 1160).

A wide variety of etch chemistries may be used in the first etch solution and the second solution, depending on the noble metal being etched. In some embodiments, for example, the first etch solution may include potassium chloride (KCl) as the non-acidic chloride ion source, potassium hydroxide (KOH) as the base, and ammonium persulfate (APS) or tetrabutylammonium peroxymonosulfate (TBAPMS) as the oxidizer. The chloro-metalate salt, the oxychlorometalate salt or the hydrate of the chloro-metalate salt or the oxychlorometalate salt may be insoluble in the first etch solution and soluble in the second etch solution.

In some embodiments, the first etch solution may be a basic aqueous oxidizing solution having a pH value greater than 7. In such embodiments, said b) exposing the noble metal layer to the first etch solution (in step 1120) may at least partially hydrolyze the chloro-metalate salt, the oxychlorometalate salt or the hydrate of the chloro-metalate salt or the oxychlorometalate salt to a noble metal oxide, hydroxide or salt hydrate layer, which is insoluble in the first etch solution, yet soluble within the second etch solution. In some embodiments, the second etch solution may be an acidic dissolution solution. In such embodiments, said d) exposing the chemically modified noble metal surface layer to the second etch solution (in step 1140) may dissolve the noble metal oxide, hydroxide or salt hydrate layer and re-chlorinate any remaining noble metal oxide into the chloro-metalate salt, the oxychlorometalate salt or the hydrate of the chloro-metalate salt or the oxychlorometalate salt. The chloro-metalate salt, the oxychlorometalate salt or the hydrate of the chloro-metalate salt or the oxychlorometalate salt may be insoluble in the first etch solution and soluble in the second etch solution and the second purge solution.

It is noted that reference throughout this specification to "one embodiment" or "an embodiment" means that a particular feature, structure, material, or characteristic described in connection with the embodiment is included in at least one embodiment of the invention, but do not denote that they are present in every embodiment. Thus, the appearances of the phrases "in one embodiment" or "in an embodiment" in various places throughout this specification are not necessarily referring to the same embodiment of the invention. Furthermore, the particular features, structures, materials, or characteristics may be combined in any suitable manner in one or more embodiments. Various additional layers and/or structures may be included and/or described features may be omitted in other embodiments.

The term "substrate" as used herein means and includes a base material or construction upon which materials are formed. It will be appreciated that the substrate may include a single material, a plurality of layers of different materials, a layer or layers having regions of different materials or different structures in them, etc. These materials may include semiconductors, insulators, conductors, or combinations thereof. For example, the substrate may be a semiconductor substrate, a base semiconductor layer on a supporting structure, a metal electrode or a semiconductor substrate having one or more layers, structures or regions formed thereon. The substrate may be a conventional silicon substrate or other bulk substrate comprising a layer of semi-conductive material. As used herein, the term "bulk substrate" means and includes not only silicon wafers, but also silicon-on-insulator ("SOI") substrates, such as silicon-on-sapphire ("SOS") substrates and silicon-on-glass ("SOG") substrates, epitaxial layers of silicon on a base semiconductor foundation, and other semiconductor or optoelectronic materials, such as silicon-germanium, germanium, gallium arsenide, gallium nitride, and indium phosphide. The substrate may be doped or undoped.

Systems and methods for processing a substrate are described in various embodiments. The substrate may include any material portion or structure of a device, particularly a semiconductor or other electronics device, and may, for example, be a base substrate structure, such as a semiconductor substrate or a layer on or overlying a base substrate structure such as a thin film. Thus, substrate is not intended to be limited to any particular base structure, underlying layer or overlying layer, patterned or unpatterned, but rather, is contemplated to include any such layer or base structure, and any combination of layers and/or base structures.

One skilled in the relevant art will recognize that the various embodiments may be practiced without one or more of the specific details, or with other replacement and/or additional methods, materials, or components. In other instances, well-known structures, materials, or operations are not shown or described in detail to avoid obscuring aspects of various embodiments of the invention. Similarly, for purposes of explanation, specific numbers, materials, and configurations are set forth in order to provide a thorough understanding of the invention. Nevertheless, the invention may be practiced without specific details. Furthermore, it is understood that the various embodiments shown in the figures are illustrative representations and are not necessarily drawn to scale.

Further modifications and alternative embodiments of the described systems and methods will be apparent to those skilled in the art in view of this description. It will be recognized, therefore, that the described systems and methods are not limited by these example arrangements. It is to be understood that the forms of the systems and methods herein shown and described are to be taken as example embodiments. Various changes may be made in the implementations. Thus, although the ruthenium wet ALE techniques are described herein with reference to specific embodiments, various modifications and changes can be made without departing from the scope of the present disclosure. Accordingly, the specification and figures are to be regarded in an illustrative rather than a restrictive sense, and such modifications are intended to be included within the scope of the present disclosure. Further, any benefits, advantages, or solutions to problems that are described herein with regard to specific embodiments are not intended to be construed as a critical, required, or essential feature or element of any or all the claims.

What is claimed is:

1. A method of etching, the method comprising:

receiving a substrate having a noble metal formed thereon, wherein a noble metal surface is exposed on a surface of the substrate;

exposing the surface of the substrate to a surface modification solution such that the surface modification solution is in contact with the noble metal surface, wherein the surface modification solution includes a persulfate salt, a chloride ion source and a cation, and wherein the persulfate salt reacts with the chloride ion source to form dichloride radical ions, which oxidize the noble metal surface to form a noble metal salt passivation layer;

removing the surface modification solution from the surface of the substrate subsequent to forming the noble metal salt passivation layer;

exposing the surface of the substrate to a dissolution solution that reacts with the noble metal salt passivation layer to form soluble species that are dissolved by the dissolution solution; and removing the dissolution solution and the soluble species from the substrate.

2. The method of claim 1, wherein the noble metal is ruthenium (Ru), gold (Au), platinum (Pt) or iridium (Ir), and wherein the noble metal salt passivation layer is a chloro-metalate salt, an oxychlorometalate salt, or a hydrate of the chloro-metalate salt or the oxychlorometalate salt.

3. The method of claim 1, wherein the persulfate salt is an ammonium or quaternary ammonium cation salt of the persulfate or peroxymonosulfate ion.

4. The method of claim 1, wherein the chloride ion source is hydrochloric acid (HCl) or a non-acidic chloride ion source comprising (1) potassium chloride (KCl), (2) tetrabutylammonium chloride (TBAC), (3) tetramethyl ammonium chloride (TMAC), (4) 1-butyl-3-methylimidazolium chloride and/or other soluble metal chlorides, (5) ammonium chlorides, (6) imidazolium chlorides, and (7) chloride salts of phosphoniums, pyrrolidiniums, guanidiniums, triazoliums, quinoliniums and/or other organic cations.

5. The method of claim 1, wherein the dissolution solution is an aqueous dissolution solution containing an acid comprising hydrochloric acid (HCl), nitric acid and/or sulfuric acid.

6. The method of claim 1, wherein the dissolution solution is a solvent comprising deionized water, acetonitrile, alcohols, acetates, ethers and/or ketones.

7. The method of claim 1, wherein the surface modification solution comprises: (a) ammonium persulfate (APS) or tetrabutylammonium peroxymonosulfate (TBAPMS) as the persulfate salt, and (b) tetrabutylammonium chloride (TBAC) as the chloride ion source, and wherein said exposing the surface of the substrate to the surface modification solution oxidizes the noble metal surface and forms the noble metal salt passivation layer in a continuous oxidation process.

8. The method of claim 1, wherein the surface modification solution comprises: (a) ammonium persulfate (APS) or tetrabutylammonium peroxymonosulfate (TBAPMS) as the persulfate salt, (b) potassium chloride (KCl) as the chloride ion source, and (c) a base, and wherein said exposing the surface of the substrate to the surface modification solution oxidizes the noble metal surface and forms the noble metal salt passivation layer in a self-limiting oxidation process.

9. The method of claim 1, wherein the surface modification solution comprises: (a) ammonium persulfate (APS) or tetrabutylammonium peroxymonosulfate (TBAPMS) as the persulfate salt, and (b) hydrochloric acid (HCl) as the chloride ion source, and wherein said exposing the surface of the substrate to the surface modification solution oxidizes the noble metal surface and forms the noble metal salt passivation layer in a self-limiting oxidation process.

10. A method of etching, the method comprising:

receiving a substrate having a noble metal formed thereon, wherein a noble metal surface is exposed on a surface of the substrate;

exposing the surface of the substrate to a surface modification solution such that the surface modification solution is in contact with the noble metal surface, wherein the surface modification solution includes: (a) a chloride ion source, (b) a persulfate salt that reacts with the chloride ion source to form dichloride radical ions, which oxidize the noble metal surface to form a noble metal salt passivation layer, and (c) an acid or a base to adjust a pH of the surface modification solution and control an oxidation behavior of the noble metal salt passivation layer;

removing the surface modification solution from the surface of the substrate subsequent to forming the noble metal salt passivation layer;

exposing the surface of the substrate to a dissolution solution that reacts with the noble metal salt passivation layer to form soluble species that are dissolved by the dissolution solution; and removing the dissolution solution and the soluble species from the substrate.

11. The method of claim 10, wherein the noble metal is ruthenium (Ru), gold (Au), platinum (Pt) or iridium (Ir), and wherein the noble metal salt passivation layer is a chloro-metalate salt, an oxychlorometalate salt, or a hydrate of the chloro-metalate salt or the oxychlorometalate salt.

12. The method of claim 10, wherein the surface modification solution includes an ammonium or quaternary ammonium cation salt of the persulfate or peroxymonosulfate ion as the persulfate salt.

13. The method of claim 12, wherein the surface modification solution further includes a non-acidic chloride ion source and the acid, wherein the acid decreases the pH of the surface modification solution to oxidize the noble metal surface and form the noble metal salt passivation layer in a continuous oxidation process.

14. The method of claim 13, wherein the surface modification solution includes tetrabutylammonium chloride (TBAC) as the non-acidic chloride ion source, tetrabutylammonium peroxymonosulfate (TBAPMS) as the persulfate salt, and hydrochloric acid (HCl) as the acid.

15. The method of claim 12, wherein the surface modification solution further includes a non-acidic chloride ion source and the base, and wherein the base increases the pH of the of the surface modification solution to oxidize the noble metal surface and form the noble metal salt passivation layer in a self-limiting oxidation process.

16. The method of claim 15, wherein the surface modification solution includes potassium chloride (KCl) as the non-acidic chloride ion source, tetrabutylammonium peroxymonosulfate (TBAPMS) as the persulfate salt, and potassium hydroxide (KOH) as the base.

17. The method of claim 12, wherein the surface modification solution further includes an acidic chloride ion source as the chloride ion source and the acid, wherein the acidic chloride ion source changes a ratio of cations in the surface modification solution to oxidize the noble metal surface and form the noble metal salt passivation layer in a self-limiting oxidation process.

18. The method of claim 17, wherein the surface modification solution includes tetrabutylammonium peroxymonosulfate (TBAPMS) as the persulfate salt and hydrochloric acid (HCl) as the acidic chloride ion source.

19. A method of etching a substrate using a wet atomic layer etching (ALE) process, the method comprising:

a) receiving the substrate, the substrate having a noble metal layer thereon;

b) exposing the noble metal layer to a first etch solution containing a non-acidic chloride ion source, a base and an oxidizer that reacts with the non-acidic chloride ion source to form dichloride radical ions, which oxidize an exposed surface of the noble metal layer to form a chemically modified noble metal surface layer containing a chloro-metalate salt, an oxychlorometalate salt or a hydrate of the chloro-metalate salt or the oxychlorometalate salt, which is self-limiting and insoluble in the first etch solution;

c) rinsing the substrate with a first purge solution to remove the first etch solution from a surface of the substrate;

d) exposing the chemically modified noble metal surface layer to a second etch solution to dissolve the chemically modified noble metal surface layer;

e) rinsing the substrate with a second purge solution to remove the second etch solution from the surface of the substrate; and f) repeating steps b)-e) for one or more cycles.

20. The method of claim 19, wherein the first etch solution comprises potassium chloride (KCl) as the non-acidic chloride ion source, potassium hydroxide (KOH) as the base, and ammonium persulfate (APS) or tetrabutylammonium peroxymonosulfate (TBAPMS) as the oxidizer.

21. The method of claim 19, wherein the chloro-metalate salt, the oxychlorometalate salt or the hydrate of the chloro-metalate salt or the oxychlorometalate salt is insoluble in the first etch solution and soluble in the second etch solution.

22. The method of claim 19, wherein the first etch solution is a basic aqueous oxidizing solution having a pH value greater than 7, and wherein said b) exposing the noble metal layer to the first etch solution at least partially hydrolyzes the chloro-metalate salt, the oxychlorometalate salt or the hydrate of the chloro-metalate salt or the oxychlorometalate salt to a noble metal oxide, hydroxide or salt hydrate layer, which is insoluble in the first etch solution and soluble within the second etch solution.

23. The method of claim 22, wherein the second etch solution is an acidic dissolution solution, and wherein said d) exposing the chemically modified noble metal surface layer to the second etch solution dissolves the noble metal oxide, hydroxide or salt hydrate layer and re-chlorinates any remaining noble metal oxide, hydroxide or salt hydrate layer into the chloro-metalate salt, the oxychlorometalate salt or the hydrate of the chloro-metalate salt or the oxychloro-metalate salt.

24. The method of claim 23, wherein the chloro-metalate salt, the oxychlorometalate salt or the hydrate of the chloro-metalate salt or the oxychlorometalate salt is insoluble in the first etch solution and soluble in the second etch solution and the second purge solution.

* * * * *